US006045254A

United States Patent [19]

Inbar et al.

[11] Patent Number: 6,045,254

[45] Date of Patent: Apr. 4, 2000

[54] CONTAINER HAVING TWO OR MORE COMPARTMENTS

[75] Inventors: Michael Inbar, D.N. Shimkin; Sharon Igal, Caesaria, both of Israel

[73] Assignee: M.L.I.S. Projects Ltd., Tel Aviv, Israel

[21] Appl. No.: 08/996,411

[22] Filed: Dec. 22, 1997

Related U.S. Application Data

[63] Continuation of application No. 08/839,136, Apr. 23, 1997, which is a continuation-in-part of application No. 08/811,007, Mar. 4, 1997, which is a continuation-in-part of application No. 08/773,154, Dec. 26, 1996, abandoned.

[30] Foreign Application Priority Data

| | | | |
|---|---|---|---|
| Aug. 29, 1997 | [IL] | Israel | 121657 |
| Sep. 16, 1997 | [IL] | Israel | 121782 |

[51] Int. Cl.[7] ..... B65D 25/08; B01F 11/00

[52] U.S. Cl. ..... 366/130; 206/222; 215/DIG. 8

[58] Field of Search ..... 366/130, 129; 206/219, 220, 221, 222; 215/6, 11.1, DIG. 8

[56] References Cited

U.S. PATENT DOCUMENTS

| | | | |
|---|---|---|---|
| 611,520 | 9/1898 | Smith | 206/221 |
| 2,494,294 | 1/1950 | Greenberg | 208/47 |
| 2,689,566 | 9/1954 | Lockhart | 128/233 |
| 2,786,769 | 3/1957 | Greenspan | 99/171 |
| 2,793,776 | 5/1957 | Lipari | 215/6 |
| 2,807,384 | 9/1957 | Lipari | 215/11 |
| 2,813,649 | 11/1957 | Lipari | 215/11 |
| 2,931,731 | 4/1960 | Pohjola | 99/171 |
| 3,220,588 | 11/1965 | Lipari | 215/11 |
| 3,314,563 | 4/1967 | Mounier | 215/6 |
| 3,458,076 | 7/1969 | Babcock | 215/6 |
| 3,477,431 | 11/1969 | Walecka | 128/218 |
| 3,651,990 | 3/1972 | Cernei | 222/94 |
| 3,856,138 | 12/1974 | Mekawa et al. | 206/221 |
| 4,387,988 | 6/1983 | Szigeti | 366/130 |
| 4,410,085 | 10/1983 | Beneziat et al. | 206/217 |
| 4,711,359 | 12/1987 | White et al. | 215/11.1 |

(List continued on next page.)

FOREIGN PATENT DOCUMENTS

| | | |
|---|---|---|
| 0 357 288 | 8/1989 | European Pat. Off. . |
| 0 357 288 A1 | 3/1990 | European Pat. Off. . |
| 0 673 847 | 3/1995 | European Pat. Off. . |
| 0 673 847 A1 | 9/1995 | European Pat. Off. . |
| 2615729 | 12/1988 | France . |
| 43 26 152 A1 | 2/1995 | Germany . |
| 43 26 152 | 9/1995 | Germany . |
| 679145 | 12/1991 | Switzerland . |

*Primary Examiner*—Tony G. Soohoo

[57] ABSTRACT

A container for storing two components separately and then mixing them prior to use includes a housing having an opening and a neck portion, a displaceable member, and a closure member. The housing is formed with a first compartment and a second compartment intercommunicating at the neck portion. The displaceable member has a partition wall for sealing the neck portion. The displaceable member is formed such that the partition wall moves from a non-sealing position in which the first and second compartments intercommunicate to a sealing position in which the neck portion is sealed. The displaceable member also may feature at least one conduit for allowing introduction of a component through the opening into the housing. The closure member seals the at least one conduit of the displaceable member and/or the opening of the housing. The displaceable member may be moved by rotating, pushing or pulling and may be moveable by a portion exterior to the housing. The seal formed by the partition wall of the displaceable member may be reformable, i.e., capable of being resealed. A prepackaged, single use, two compartment container according to some embodiments of the invention have an unremovable closure member, an unreformable seal, an unfastenable closure member after it has been removed or is constructed in a manner or of materials which allow only a single use. The two-compartment container may also include a dosing assembly for dispensing a predetermined quantity of mixed formulation.

105 Claims, 22 Drawing Sheets

U.S. PATENT DOCUMENTS

| | | | |
|---|---|---|---|
| 4,727,985 | 3/1988 | McNeirney et al. | 206/221 |
| 4,776,972 | 10/1988 | Barrett | 252/90 |
| 4,779,722 | 10/1988 | Hall | 206/221 |
| 4,823,946 | 4/1989 | Stoeffler et al. | 206/221 |
| 4,936,446 | 6/1990 | Lataix | 206/221 |
| 5,088,627 | 2/1992 | Musel | 222/145 |
| 5,277,303 | 1/1994 | Goyet et al. | 206/221 |
| 5,330,048 | 7/1994 | Haber et al. | 206/221 |
| 5,348,060 | 9/1994 | Futagawa et al. | 141/100 |
| 5,353,961 | 10/1994 | Debush | 222/94 |
| 5,417,321 | 5/1995 | Halm | 206/221 |
| 5,419,445 | 5/1995 | Kaesemeyer | 215/11.1 |
| 5,429,254 | 7/1995 | Christine | 215/11.1 |
| 5,433,328 | 7/1995 | Baron et al. | 215/11.1 |
| 5,447,226 | 9/1995 | Laine | 206/219 |
| 5,474,209 | 12/1995 | Mas et al. | 222/83 |
| 5,540,341 | 7/1996 | Holley et al. | 214/11.4 |
| 5,564,600 | 10/1996 | Renault | 221/129 |
| 5,593,028 | 1/1997 | Haber et al. | 206/221 |
| 5,613,623 | 3/1997 | Hildebrandt | 222/129 |
| 5,634,714 | 6/1997 | Guild | 366/130 |
| 5,638,968 | 6/1997 | Baron et al. | 214/11.4 |
| 5,685,422 | 11/1997 | Kim | 206/222 |
| 5,692,644 | 12/1997 | Gueret | 222/80 |

CONTAINER HAVING TWO OR MORE COMPARTMENTS

This is a continuation of U.S. application Ser. No. 08/839,136 filed Apr. 23, 1997 which is a continuation-in-part of U.S. application Ser. No. 08/881,007 filed Mar. 4, 1997 which is a continuation-in-part of U.S. application Ser. No. 08/773,154 filed Dec. 12, 1996, now abandoned.

FIELD OF THE INVENTION

The present invention relates to two compartment containers and in particular a single use two-compartment container, each compartment holding a separate component, for example, a liquid or a solid component, to be mixed with one another by the end user prior to use.

BACKGROUND OF THE INVENTION

A variety of formulations for human use are stored in the form of a dry particulate matter (powder) and are mixed with a liquid shortly before use to form a true solution or a dispersion. This is the case, for example, with various nutritive formulas, including maternal milk substitute formulas (baby formula), adult feeding formulas such as dietetic powders and a variety of drugs, e.g., antibiotics. The shelf life of such mixed liquid formulations is limited, and this dictates the need to prepare them only shortly before use. The limited shelf life of the mixed formulation is the result of a loss of activity of an active ingredient in the formula, for example, loss of activity due to accelerated oxidation and/or hydrolysis once the ingredient is mixed with a liquid, etc. In addition, in many cases, the mixed formulation can be more susceptible to micro-organism contamination.

In some applications, for example, formula for newborn babies and various drugs including antibiotics, it is important that a correct amount (weight and/or volume) of the dry particulate material be admixed with a correct amount (weight and/or volume) of the liquid when preparing the resulting formula. Too much or too little of any one of the required components alters the ratio and changes the resulting formulation which may need to be within close tolerances to have the appropriate effect. For example, in the case of baby formula if there is not enough dry formula the mixed liquid formulation will be diluted in which case the baby or infant will be undernourished, or if there is too much dry formula the mixed liquid formulation will be too concentrated which may give rise to digestive problems and vomiting.

In addition, in some applications it may be necessary that the filling, storing and mixing of the two compartments be performed under hygienic and in some cases sterile conditions and that the two components be of appropriate sterility and quality.

The preparation of baby formula in the home and hospitals is typically accomplished by providing cleaned and sterilized bottles and nipples, measuring a quantity of the powdered (dry particulate) material from a canister and placing it in the previously cleaned and sterilized bottle to which an appropriate measured amount of water (generally tap water), saline solution or milk is added. The nipple is then attached and the two constituents or components are then agitated to form the mixed liquid formula. A variety of drugs, for example, antibiotics are prepared in a similar manner by the pharmacist or the end user.

In applications where a formula prepared by mixing two constituents has a short shelf-life or where the quantities, quality or sterility of the constituents is an important consideration in the preparation of the formula, a single container which could separately store the two constituents until the mixed formula is to be dispensed, permit the two constituents to be mixed in the container and permit the mixed formula to be dispensed from the container would be useful. In some such applications it may further be desirable that the container be pre-packaged and yet further desirable that it be configured and adapted for a single use by the end user and even more desirable that the container be unusable after the single use. Such storage and dispensing containers would offer convenience, safety and potential savings to the end user.

First, a pre-packaged two-compartment storage and dispensing container offers the convenience of having both constituent parts of a mixed formulation supplied in the correct amounts in a single easy to use container that is always ready to be mixed. In this manner, a traveler may take along as many pre-packaged containers as desired and mix the formula for use at any time, without having to measure the two or more constituents, or worry about forgetting or obtaining one of the constituents of the formula while traveling. Such a pre-packaged container, filled and packaged under the appropriate conditions, separately storing the constituent elements of a formula in a ready to mix manner, and adaptable to mix and dispense the resulting formulation provides a complete system for the end user.

Second, single use two-compartment storage and dispensing containers offer the safety of being packaged in a manufacturing plant where the sterility of the environment and the quality and sterility of each of the constituents and mixed formula can be controlled. In addition, the quantity of each of the two separate components can be controlled through precise measurement if prepackaged in a single use container in a manufacturing facility.

Containers having separate compartments for storing two components, e.g., one being a dry particulate substance and the other being a liquid, both of which are mixed together prior to use, are known. Such two-compartment containers typically employ a breakable or displaceable partition between the two compartments. The partition is then either broken or displaced, as the case may be, to allow mixing.

A major problem with known two-container designs is the complexity of the assembly, filling and packaging process. This complexity results from the need to assemble an internal partition, which may in itself be designed to be fragile or easily displaceable, through the typically restricted access of the container opening. There is therefore a need for two-compartment containers which are easily manufactured and simplify the assembly, filling and packaging process while offering easy and reliable operation.

SUMMARY OF THE INVENTION

It is an object of the invention to provide a novel, container having two or more compartments for storing two or more components intended to be mixed prior to use, the first of such components being typically a liquid and the other a particulate solid, e.g., powdered substance. It is a further object to provide a two or more compartment storage and dispensing container which can be easily assembled and filled with two or more components. It is a still further object to provide a two or more compartment storage container which can be assembled and filled in a sterile environment and that the sterile condition is not compromised by preparation and dispensing of the mixed formula. It is another object to provide a two or more compartment container for storing two or more components intended to be mixed prior to use and which dispenses the ultimate formulation formed by mixing the two or more components.

It is an object of the invention to provide a two or more compartment container which separately stores two or more components until they are to be mixed, permits the easy mixture of the two or more components and permits the mixed formula to be dispensed. It is yet an additional object to provide a two or more compartment container which can be externally activated to allow the two or more separately stored components to be admixed in an easy and reliable manner by an inexperienced end user. It is still yet another object of the invention to provide a complete system via a two or more compartment container which is filled with the correct amount of each individual component to achieve an optimum mixed formula. It is a further object in some cases to provide a single use two or more compartment container for storing two or more components intended to be mixed prior to use and which disperses the ultimate formulation formed by mixing the two or more components and which thereafter is no longer capable of being reused.

In accordance with one embodiment of the present invention, there is provided a container comprising:

a housing having a dispensing opening, a bottom end and a neck portion between said opening and said bottom end; and a displaceable member disposed within said housing having a partition wall adapted to form a fluid tight seal at said neck portion thereby defining two compartments separated by at least a portion of said partition wall;

said displaceable member being axially displaceable between two positions along an axis extending through said neck portion, said two positions comprising a first position where a fluid tight seal is formed at said neck portion, and a second position where the partition wall is disengaged from the neck portion to permit flow communication between the two compartments.

The neck portion thus divides the container into two compartments, one remote from said opening defining a first compartment and another adjacent said opening defining a second compartment, the two compartments being separated from one another by and sharing at least a portion of said partition wall when it is in its first position. The neck portion may be formed as a constricted portion having a smaller cross section than adjacent areas of the housing. In accordance with another embodiment the neck portion may be formed by an annular, inwardly-projecting, radial wall.

In one embodiment of the invention the housing is cylindrical, the neck portion has a circular cross-section and the partition wall is circular. In some embodiments the edge of said partition wall is adaptable and configured to form a liquid tight seal with said neck portion. This may be achieved by a resilient portion forming an integral part of said edge or by a resilient member integrated into said edge, e.g. an O-ring fitted into an annular groove formed in said edge, cooperating male-female type engagement members, one in the partition wall and the other in the neck portion, respectively, etc. The seal formed may be reformable, i.e., that is resealable, or it may be incapable of reestablishing a seal.

The partition wall typically projects from a manipulable portion of the displaceable member, which is user operable to allow displacement control. The manipulable portion may be exterior to the housing and preferably is easily accessible and operated by the end user. In one example, the partition wall is connected at an end of one or more stems projecting from said manipulable portion. In the case of a single stem, it will typically be central, and in the case of a plurality of stems, it will typically be disposed in the periphery. In another example, the partition wall and the manipulable portion may be connected by a peripheral wall formed with openings. In a further example, the connection between the partition wall and the manipulable portion is by means of radial wall sections. Said manipulable portion of the displaceable member may, in accordance with one embodiment of the invention, be adapted for screw engagement with the housing such that axial displacement is achieved by the relative advance as a result of helical displacement during rotation. In this case the seal formed by the partition wall is controlled by rotation of a threaded displaceable member. In accordance with another embodiment of the invention, said displaceable member is engaged with the housing such that it is axially displaceable by means of pulling, or pushing, on said manipulable portion such that the partition wall engages or disengages with the neck portion.

The container, according to one embodiment, comprises a housing defining a first compartment and a second compartment which intercommunicate at a neck portion, a threaded portion circumscribing an opening, a displaceable member having a threaded part for rotatably engaging the threaded portion of the container and a partition wall for sealing the neck portion, the displaceable member being formed such that, when the displaceable member is rotated with the threaded part engaging the threaded portion, the partition wall moves from a non-sealing position in which the first and second compartments intercommunicate to a sealing position in which the neck portion is sealed, the displaceable member further featuring at least one conduit for allowing introduction of a component through the opening into or out of the second compartment whether or not the displaceable member is in its sealing position. In this embodiment the conduit communicates with and provides a passageway through the opening into the container. It is understood that a separate second opening for dispensing the mixed formulation may be provided in the container.

The at least one conduit may be circumscribed by the threaded part of the displaceable member, the opening may be substantially cylindrical, and the seal may include an O-ring seal. The container may further comprise a secondary seal for sealing the at least one conduit. According to a further feature of this embodiment there may also be provided a feeding nipple attached to the displaceable member or the container and in communication with the opening. The secondary seal may be exterior to the feeding nipple.

A further embodiment of the present invention provides a container, comprising: side walls, a dispensing opening at a top end, a bottom wall, and a partition wall dividing the container in a fluid tight manner into two compartments each for holding one of the two components; the container having a displaceable vertical elongated member with a bottom end connected to the bottom wall and its top end connected to the partition wall such that vertical axial displacement of the bottom wall yields a vertical displacement of the displaceable elongated member causing movement of the partition wall.

In accordance with one aspect of this embodiment, the partition wall is integrally connected to an internal face of the side walls through a connecting zone which is breakable or tearable by vertical displacement thereof, and the elongated member extends downwardly from the partition wall to the bottom wall of the container. In accordance with this embodiment, displacement of the elongated member causes vertical displacement of the partition wall which yields a break or tear in said connecting zone. The tearing or breaking away of the partition wall results in flow communication between the two compartments and allows mixing of the contents of the two compartments. Mixing of the contents of the two compartments yields a formulation in a ready-to-use form which may then be dispensed.

The bottom wall is typically flexible to allow vertical displacement at its center. Alternatively, rather than being entirely flexible, the bottom wall may also be rigid, having a flexible peripheral portion, allowing vertical displacement. In accordance with one embodiment, the bottom wall is, at rest, downwardly arcuated and by applying upward pressure it assumes an alternate position where it is upwardly arcuated pushing the elongated member and causing vertical displacement of the partition. In accordance with another embodiment, the bottom wall is, at rest, upwardly arcuated and the displacement is by pulling it downward into the alternate position where it is downwardly arcuated. Such pulling may be by means of a handle or knob fixed at the bottom wall. As can readily be appreciated, a container as in these embodiments can be manipulated by one hand.

In accordance with an aspect of the invention, said displaceable member may be provided with a safety mechanism for avoiding unintentional axial displacement. By one example, the safety mechanism includes at least one radially projecting lug which is engaged in a partial circumferential groove in said container, and said displaceable member is rotated between the first angular position where said at least one lug is engaged in said groove and a second angular position wherein said lug is disengaged permitting axial displacement.

The displaceable member may comprise an integral closure member sealing the dispensing opening, e.g., a breakable seal, which once broken allows one to dispense the mixed formulation from the container. The container may also be provided with a closure assembly fitted at said opening. The closure assembly may further be replaceable and may or may not cooperate with the displaceable member. In accordance with one embodiment of the invention said closure assembly comprises a removable stopper. In accordance with an embodiment of the invention, said displaceable member has a peripheral portion for displaceable engagement with a top end of the housing, and has an outwardly extending aperture defining said dispensing opening.

In accordance with another embodiment of the invention, said displaceable member is engaged in a displaceable manner to the bottom end of the housing. Typically, in accordance with this embodiment, the displaceable member has a wall, defining the bottom wall of the container, which is provided with a sealable opening to allow filling of a component into a first compartment. This embodiment typically, has a dispensing opening, but not necessarily different from the sealable opening in the displaceable member.

The dispensing opening may be fitted with a closure assembly fashioned in a manner to allow a controlled release of the formulation from the container. The closure assembly in accordance with this embodiment is fashioned in a manner depending on the intended use. For example, in the case of a container for medicinal formulation, the closure assembly may for example be a pierceable rubber stopper, adapted for inserting a syringe needle for withdrawal of the medicinal formulation; the closure assembly may also be fashioned in a manner allowing dispensing of a fixed amount of the formulation each time for a plurality of occurrences; the closure assembly may also be fashioned in the form of a spoon-shaped dispensing unit; in the case of a container intended for use as a baby's feeding bottle, the closure assembly may be a nipple sized and shaped according to its intended application. The closure assembly may also be fitted with an additional cover, e.g. foil covering a stopper or a cap covering the nipple, to secure the closure and/or maintain sterility. In the case of a cap covering a nipple, the cap may be fitted in a manner to seal the nipple's opening so as to avoid spillage of the liquid component during storage prior to mixing the liquid formulation.

The present invention further provides a closure and dispensing system useful in a baby's feeding bottle. The closure and dispensing system of the invention comprises a seat member, a nipple and a coupling member; the seat member being connected to or integral with the bottle or fitted at its opening, and having a central aperture with an annular nipple support surface on its top surrounding said aperture; the nipple having, an annular skirt or shoulder seated on the nipple support surface and having a dispensing nozzle; the coupling member being adapted for fitting over the bottle with one element thereof seated over the annular skirt of the nipple such that it presses it against the nipple's support surface. The nipple assembly may be configured and adapted so that the container is capable of only a single use. For example, the coupling member may be configured to hold the nipple in a non-removable manner, or if removable it can be configured so that it or a replacement part can no longer be fitted on the container.

By one embodiment, the dispensing opening is provided with a filter or sieve, typically an integral sieve, to filter out undissolved particles present in the formula. By another embodiment, the central aperture of the closure system is encircled by an upwardly projecting sleeve attached to the bottom internal walls of the nipple. In accordance with another embodiment, the coupling to the walls of the container by the coupling member is by means of snap fitting.

The container of the invention may be fashioned for a variety of uses. In accordance with one embodiment of the invention, said container serves as a baby's feeding bottle, in which case said first compartment contains a liquid, typically sterilized water, and said second compartment contains a powdered baby's formula. In accordance with another embodiment of the invention, said container is fashioned for storage of two components of a medicinal formulation, for example, said first compartment contains a liquid, e.g., water or a sterilized saline solution, and said second compartment contains a dry particulate drug formulation to be mixed with the liquid prior to use, e.g. an antibiotic drug formulation. Depending on the type of the formulation, the two components may be both liquids, one may be a liquid and the other may be a dry formulation or both may be dry formulations.

The relative size of the first compartment and the second compartment can be designed according to their intended use.

The container may be made for a single use, the container generally being disposable after its single use. In addition, the container may be made to be recyclable, i.e. to be returned to the manufacturer after use for refilling. Furthermore, the container may also be made in a manner to allow refilling with the two components by the end user. The container may further be constructed and made of materials to withstand heating the container in order to warm its contents.

It may be advantageous in some applications to provide a container which is only capable of a single use, in particular a pre-packaged container which is only capable of a single use, in order to prevent an end user from reusing the container. Such a container may provide a manufacturer with control over the quality of the product delivered by preventing the end user from refilling and reusing the container. A pre-packaged container offers the advantages of control over the proportion, quality and sterility of the components used and the delivered mixed formulation. It is envisioned that a single use container can be accomplished by controlling the strength of materials and construction of the container, preventing the ability to refill, destroying the operability of the container or a combination of these. For example, the container may be designed of a thin plastic material, or with a closure system which cannot be removed or re-closed after opening, or a seal that is not capable of being reformable (resealed) after it has been broken.

The present invention further provides a process for preparing a container holding two separate components of a formulation which are to be mixed with one another prior to use. In accordance with one embodiment, the process comprises:

(a) providing a container having a housing including a top and bottom end, an opening at the top end and a neck portion between the opening and the bottom end separating the container into a first bottom compartment and a second compartment adjacent said opening;

(b) introducing a first component of said formulation into the container through said opening;

(c) fitting a displaceable member into said housing, said displaceable member having a partition wall for fluid-tight sealing engagement with said neck portion, and being axially displaceable along an axis extending through said neck portion between a first position where the partition wall forms a fluid-tight seal at said neck portion, and a second position where the portion wall disengages from the neck to allow flow communication between the two compartments; said displaceable member being fitted into said container in said first position;

(d) introducing said second component into said second compartment; and (e) sealing said opening.

By another embodiment, the process comprises:

(a) providing a body for use as a housing of a container having an internal space extending between two open ends and a neck portion intermediate the two ends; one of the two open ends being fitted with an axially displaceable member comprising, a wall portion sealably engaged at said opening in a manner allowing axial displacement, a sealable filling aperture in said wall portion and a partition wall dependent from said wall portion adapted for forming a fluid-tight seal at said neck portion; said displaceable member fitted within said body such that said partition wall defines a first, bottom compartment and a second, top compartment when said partition wall is positioned at the neck portion;

(b) introducing a first component of said formulation into said first compartment through said filling aperture and sealing said aperture;

(c) introducing said second component into said second compartment through the opening at the other end of said body; and (d) sealing said opening.

In accordance with one aspect of the invention the process further comprises placing a cover over said opening. In accordance with an embodiment of the invention, the process is performed under aseptic or sterile conditions.

The invention still further provides a method for the preparation of a liquid formulation from two individual components, the method comprising:

(a) providing any one of the containers described above with each of the two components being stored in one of the container's two compartments and the displaceable member being positioned to seal the two compartments;

(b) axially displacing said displaceable member into said second compartment; and (c) agitating the container to mix the two components into said formulation.

One feature of preparing a liquid formulation using the container of the invention, particularly where the container is pre-filled in a manufacturing site, is that a correct ratio between the two components, e.g. between a powder and a liquid, may be obtained.

The invention will now be illustrated in some specific embodiments directed toward a baby's feeding bottle and a medicine container in accordance with the invention. It will be appreciated by the artisan that the same principle is also applicable in other applications and areas where it is desired to independently, i.e., separately, store two or more components of a formulation which are to be mixed prior to use.

BRIEF DESCRIPTION OF THE DRAWINGS

FIG. 13B is in a state where the partition wall seals the two compartments and FIG. 13C is in a state where the partition wall is displaced to allow communication between the two compartments;

FIG. 14 is a longitudinal cross-section through a baby's feeding body bottle in accordance with another embodiment of the invention, wherein

DETAILED DESCRIPTION OF A SPECIFIC EMBODIMENT

The below described embodiments relate to containers of the present invention, typically baby feeding bottles, having two compartments, one containing a powdered formula and the other containing a fluid, for example water. The following description is provided to illustrate various specific configurations and examples and the invention should not be regarded as being limited to these embodiments. The features of the invention may also be used for different uses, e.g. two or more compartment containers for medicinal formulations, dietary powders to be reconstituted with a liquid, alcoholic beverages to form cocktails with other ingredients, wherein one compartment contains one component and the other compartment contains another different component to be mixed to form a formulation.

While the container of the present invention is generally described as holding a dry powder component and a liquid component, the two components may be both liquids, both fluids, one may be a liquid (or a fluid) and the other may be a dry formulation or both may be dry formulas. In describing the invention the substances stored in the container have been described using the terms, "components", "constituents", "materials", "substances" and the like, interchangeably.

Figure 1:
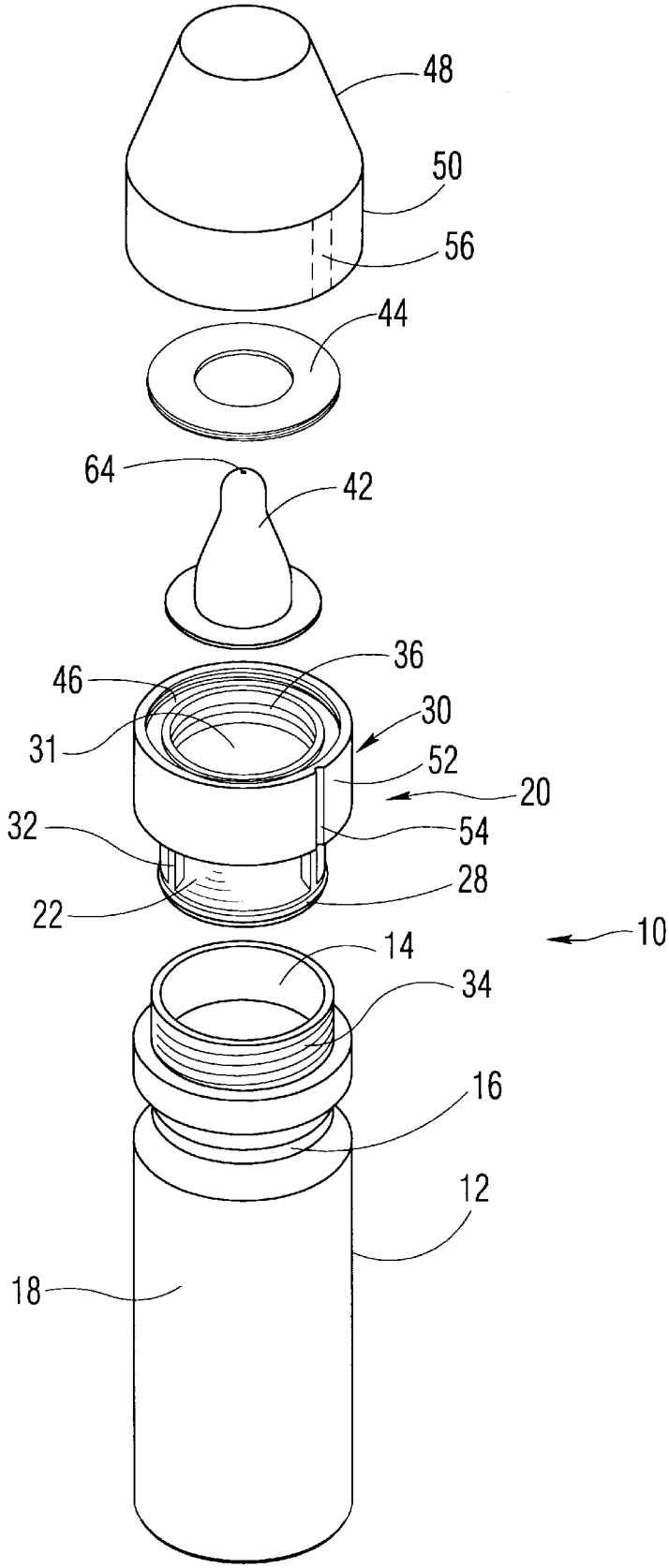
FIG. 1 is an exploded perspective view of a baby's feeding bottle in accordance with an embodiment of the invention.
Figure 2:
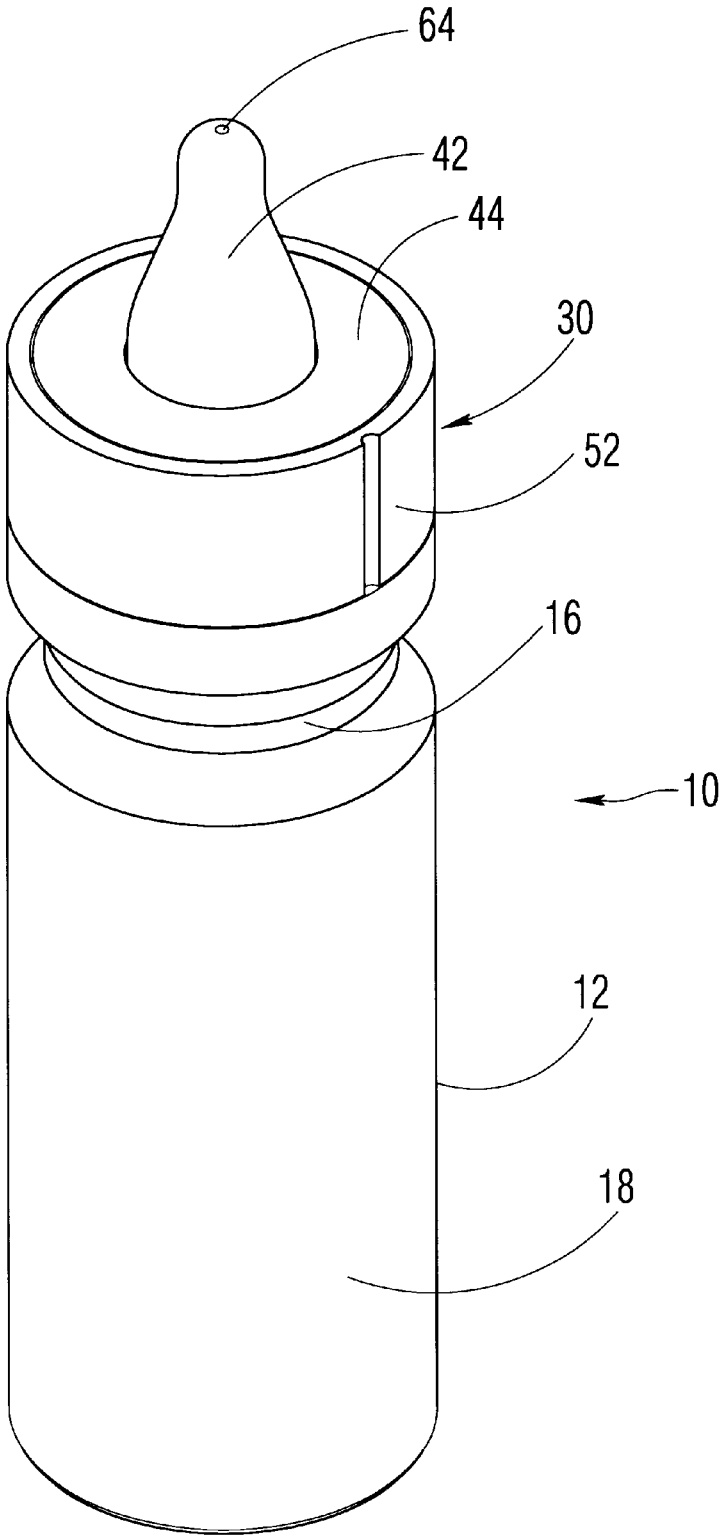
FIG. 2 is a perspective view of the baby's feeding bottle of FIG. 1 with the cover removed.
Figure 3:
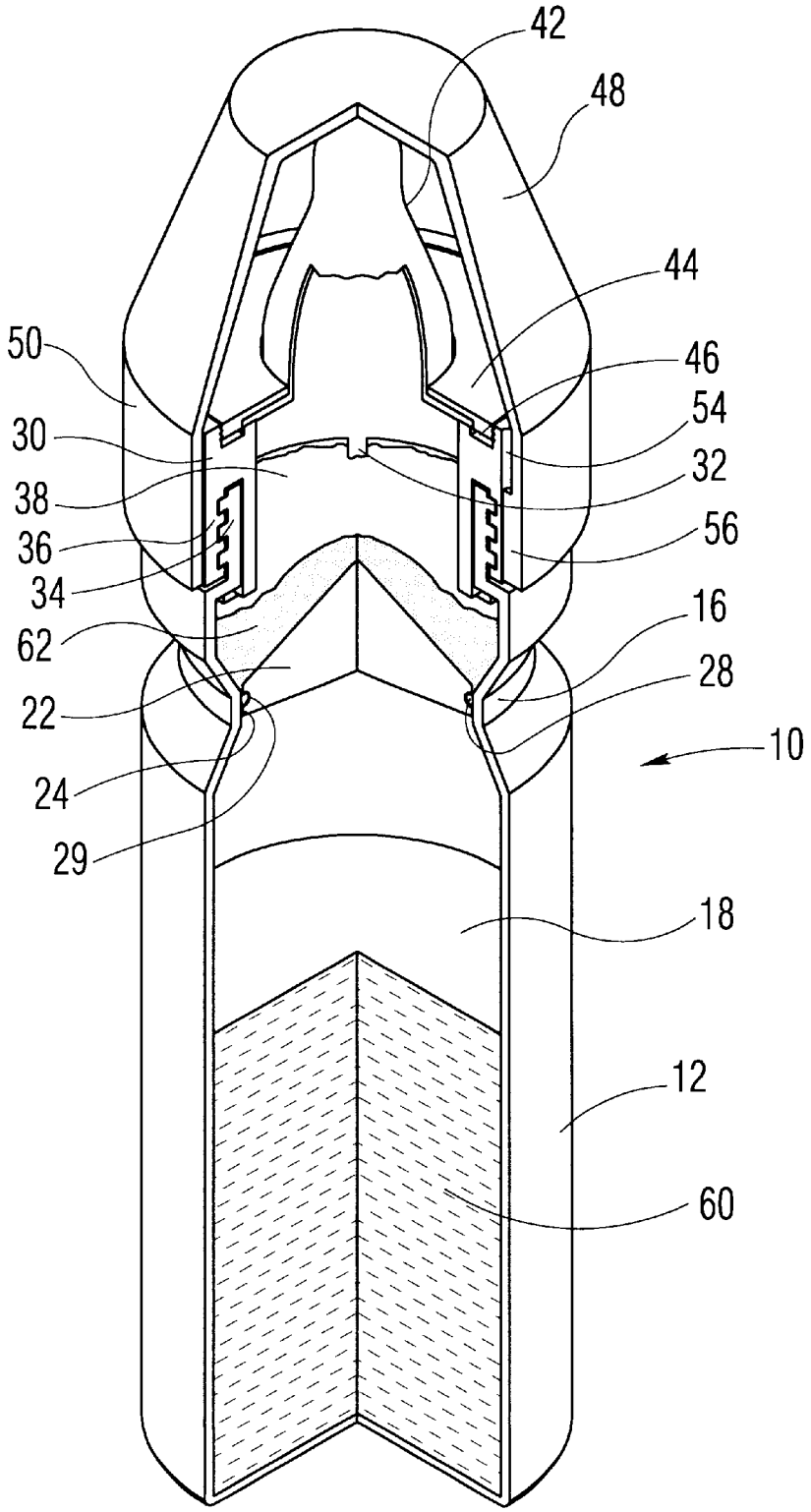
FIG. 3 is a perspective, partially cut-out view of the baby's feeding bottle in a storage position provided with a covering cap and holding two separately stored components of a liquid formulation.

A baby's feeding bottle 10 in accordance with an embodiment of the invention is shown in FIGS. 1–3. The baby's feeding bottle 10 has a general cylindrical housing 12 with an opening 14 and a constricted neck portion 16. The neck portion 16 in part defines and divides the housing 12 into what will become a first compartment 18 beneath said neck portion and a second compartment 38 (see FIG. 3) above the neck portion. The container holds a displaceable member generally designated 20 which has a partition wall 22 with an edge 24 (see FIG. 3) adapted for fluid-tight sealing engagement with internal walls of neck portion 16. The fluid-tight sealing engagement in this specific embodiment is ensured by means of a peripheral O-ring 28 fitted into an annular groove 29 provided in edge 24, although other means such as geometry and shape of edge 24 and neck portion 16 as well as materials of construction can also be used to provide the fluid-tight seal.

The partition wall 22 depends from and is connected to a manipulable portion 30 by means of one or more downward projecting stems 32 which form a connecting wall portion. In this embodiment, three radially directed stems 32 connect partition wall 22 to the manipulable portion 30. In the case of a single stem, it will typically be central, and in the case of a plurality of stems, it will typically be disposed in the periphery. In another example, the partition wall and the manipulable portion may be connected by a peripheral wall formed with openings. In a further example, the connection between the partition wall and the manipulable portion is by means of radial wall sections. Opening 14 is provided with external threading 34 at its periphery for screw-engagement with internal threading 36 in displaceable member 20.

The manipulable portion 30 has a fillable aperture 31 through which the contents of the container can be dispensed, or materials added to the container. Connecting wall portions 32, also referred to as stems, are provided with or arranged with openings 35 communicating with aperture 31 so that a passageway or conduit through displaceable member 20 is formed so that materials can be passed between the interior and exterior of housing 12.

In the specific example shown in FIGS. 1–3, when the displaceable member is fully screwed onto opening 14, the partition wall comes to a sealing engagement with internal walls of neck portion 16, as can be seen particularly in FIG. 3. In this position of the partition wall, referred to as "first state", the partition wall forms two compartments, a first compartment 18 below said partition wall and a second compartment 38 between said partition wall 22 and said opening 14. In the first state, at least a portion of the partition wall forms at least a portion of a common wall shared by both compartments. Upon rotation of the displaceable member in a counter-wise manner, the partition wall 22 is axially displaced towards the opening 14, disengaging the internal walls of neck portion 16, thus allowing communication between the two compartments, referred to as the "second state".

The baby's feeding bottle 10 has a nipple 42 which is fastened to a top end of the displaceable member 20 by means of a nipple retaining ring 44 which is snap fitted into a receptacle 46 at a top end of displaceable member 20. The baby's feeding bottle shown herein further has a cap 48 which has a cylindrical portion 50 which snugly engages the outer upper surface 52 of displaceable member 20. Cap 48 may be configured to seal opening 64 provided in the nipple 42 and protects the nipple's sterile condition. In addition, a seal made of aluminum foil, for example, may be provided over opening 14 or aperture 31 to prevent the components or mixed formula from exiting the container before desired. External face 52 of displaceable member 20 has an axial groove 54 which cooperates with a radial inwardly facing projection 56 in cap 48. By virtue of this engagement, when cap 48 is rotated, this leads to rotation of displaceable member 20 and hence to its axial displacement.

The bottle 10 may be particularly constructed for a single use through a variety of ways such as, for example, using a thin plastic material for the housing, or nipple retaining ring 44 may be made so that it cannot be removed so that the nipple is not removable and thus the container cannot be refilled, or the nipple retaining ring 44 and the top end of the displaceable member 20 may be configured and adapted such that if nipple retaining ring 44 is removed it or a replacement cannot be refastened on the container so that the nipple can no longer be held on the container, or the displaceable member can be configured and adapted so that once it has moved from its sealing position it can no longer reform a fluid-tight seal. It is envisioned that either one or a combination of these can be used in a single embodiment.

In the specific embodiment shown in FIG. 3, the first compartment 18 of the baby's feeding bottle holds a liquid 60, e.g. sterile water, and the second compartment 38 is filled with a powdered formula component 62. It is envisioned that the materials may be reversed and the first compartment 18 hold the powered formula component 62 and the second compartment 38 hold the liquid.

The manner of producing a baby's feeding bottle of the kind shown in FIGS. 1–3 is shown stepwise in FIG. 4. As will be appreciated, the manufacture is preferably performed under aseptic conditions using sterile components to ensure the bottle's sterility. In the first step of manufacture, as shown in FIG. 4A, a first component, for example, liquid 62, typically sterile water, is introduced into housing 12. The first component is preferably inserted without the displaceable member positioned on the housing, however the first component may be inserted with the displaceable member positioned on the housing. For example, the first component can be introduced with displaceable member positioned on the housing and in the second state so that the first component is permitted to pass to the first compartment, or the displaceable member may be in the first state and thereafter axially displaced to the second state before the second component is added so that the first component can pass to the first compartment. As a next step, shown in FIG. 4B, the displaceable member 20 is screw-fitted onto the opening 14 of the housing whereby the partition wall 22 comes into a sealing engagement with internal walls of neck portion 16. At a next step, shown in FIG. 4C, a second component, for example, powdered formula 62 is introduced into the second compartment 38 through aperture 31 and opening 14 followed by sealing the aperture with nipple 42 by means of retaining ring 44 (FIG. 4D) and then placing cap 48 over said nipple (FIG. 4E). In this position cap 48 seals opening 64 in the nipple 42.

When preparing a baby's feeding bottle in accordance with the invention in a manufacturing plant, the use of good quality water may be ensured. Good quality water can be defined by the concentration and composition of minerals, the lack of contamination such as heavy metals, bacteria, micro-organisms and other hazardous materials and can be achieved by processing such as by distillation. Also, and especially for newborn babies, exact amounts of powered formula and liquid can be achieved by factory automation so that the proper ratio and mixture of components is ensured, thus providing an optimal mixture that is neither too diluted nor too concentrated.

Figure 5B:
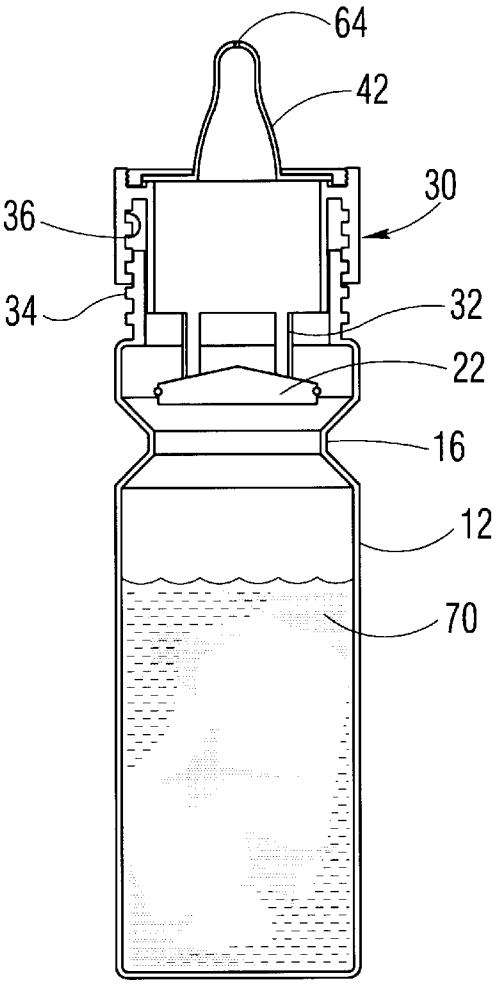
FIGS. 5A and 5B show steps in preparation of the baby's feeding bottle of FIG. 4 for feeding.
Figure 5A:
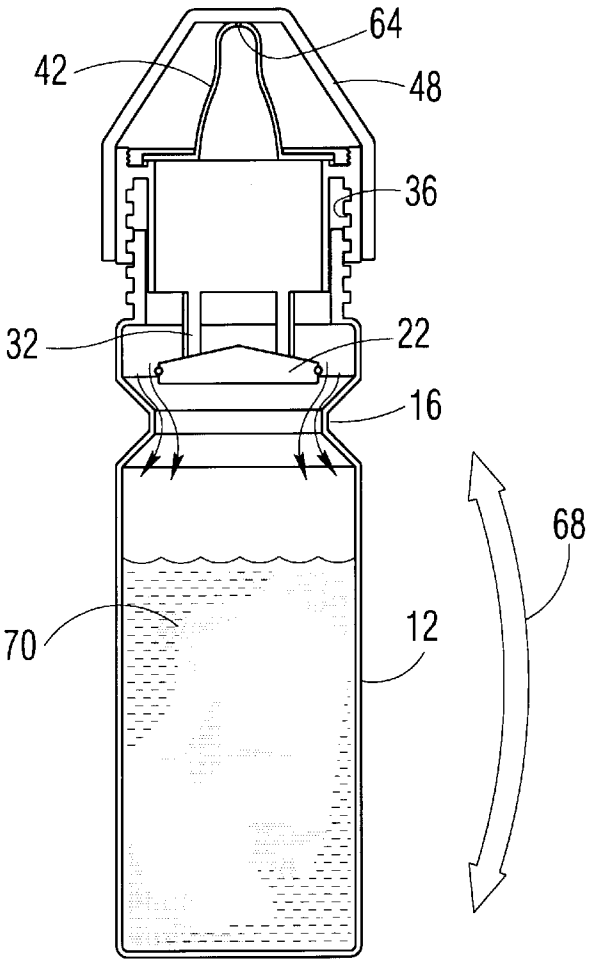

FIG. 5 shows the manner of preparing to use the baby's feeding bottle. In a first step (FIG. 5A), the displaceable member 20 is rotated whereby partition wall 22 is axially displaced whereby its edges disengage the inner walls of neck portion 16. In this position (the "second state") the two compartments (the first and the second compartment) come into flow communication with one another. This raises partition wall 22 away from neck portion 16 allowing, second component 62 to drop down into first compartment 18. In this state, cap 48 is retained on the housing such that the mixture and nipple 42 remain sterile. By agitating, shaking or turning, represented by arrow 68, the dry formula 62 and liquid 60 are mixed with one another to yield liquid formula 70. By removing cap 48, the liquid formulation can be dispensed through opening 64 of nipple 42.

Figure 6:
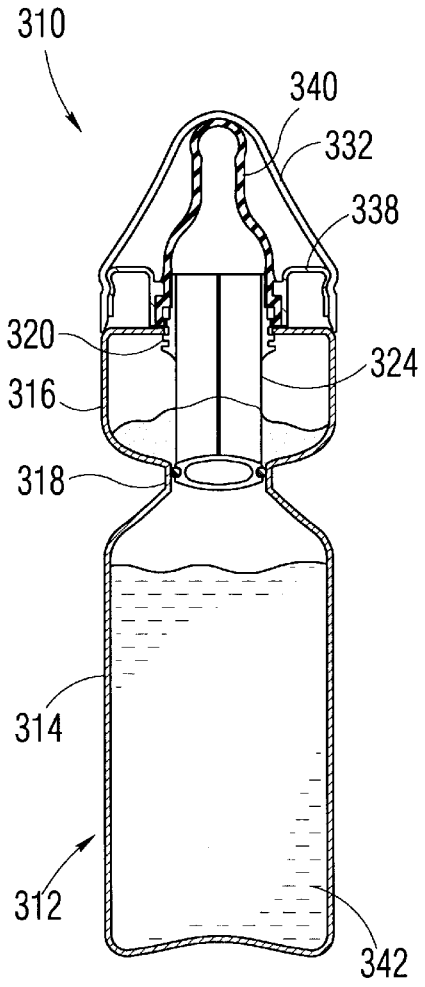
FIG. 6 is side cross-sectional view of a two compartment container with a displaceable member fully tightened.
Figure 7:
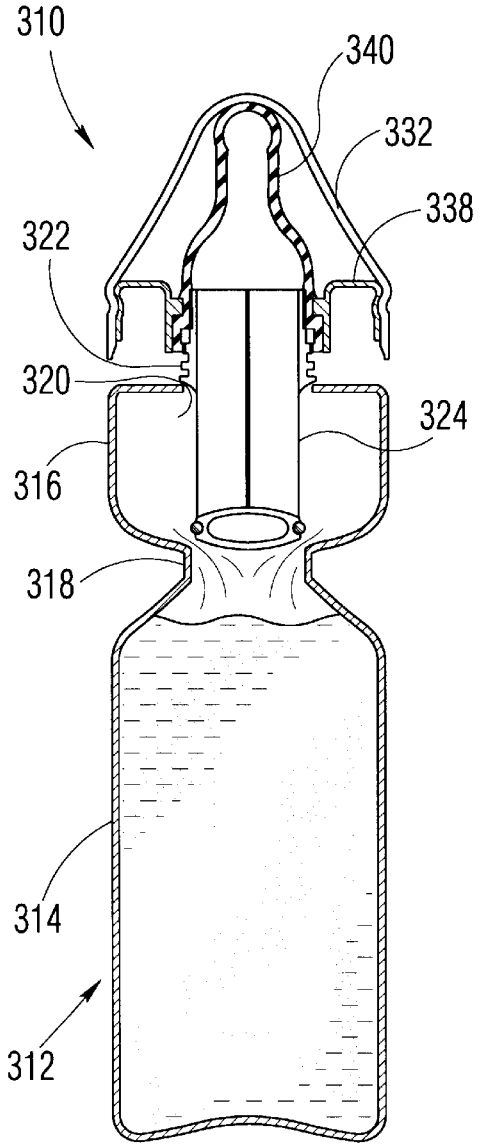
FIG. 7 is a side cross-sectional view of a two compartment container of FIG. 6 with the displaceable member partially released.

FIGS. 6 and 7 show another embodiment of a two-compartment container, generally designated 310, in which an intermediate seal is controlled externally by rotation of a threaded displaceable member. Two-compartment container 310 includes a housing 312 having a constricted neck portion 318 which defines a first compartment 314 and a second compartment 316. First compartment 314 and second compartment 316 intercommunicate at constricted neck portion 318. Second compartment 316 has an opening 320 which has a threaded portion 322 around its periphery.

Figure 8:
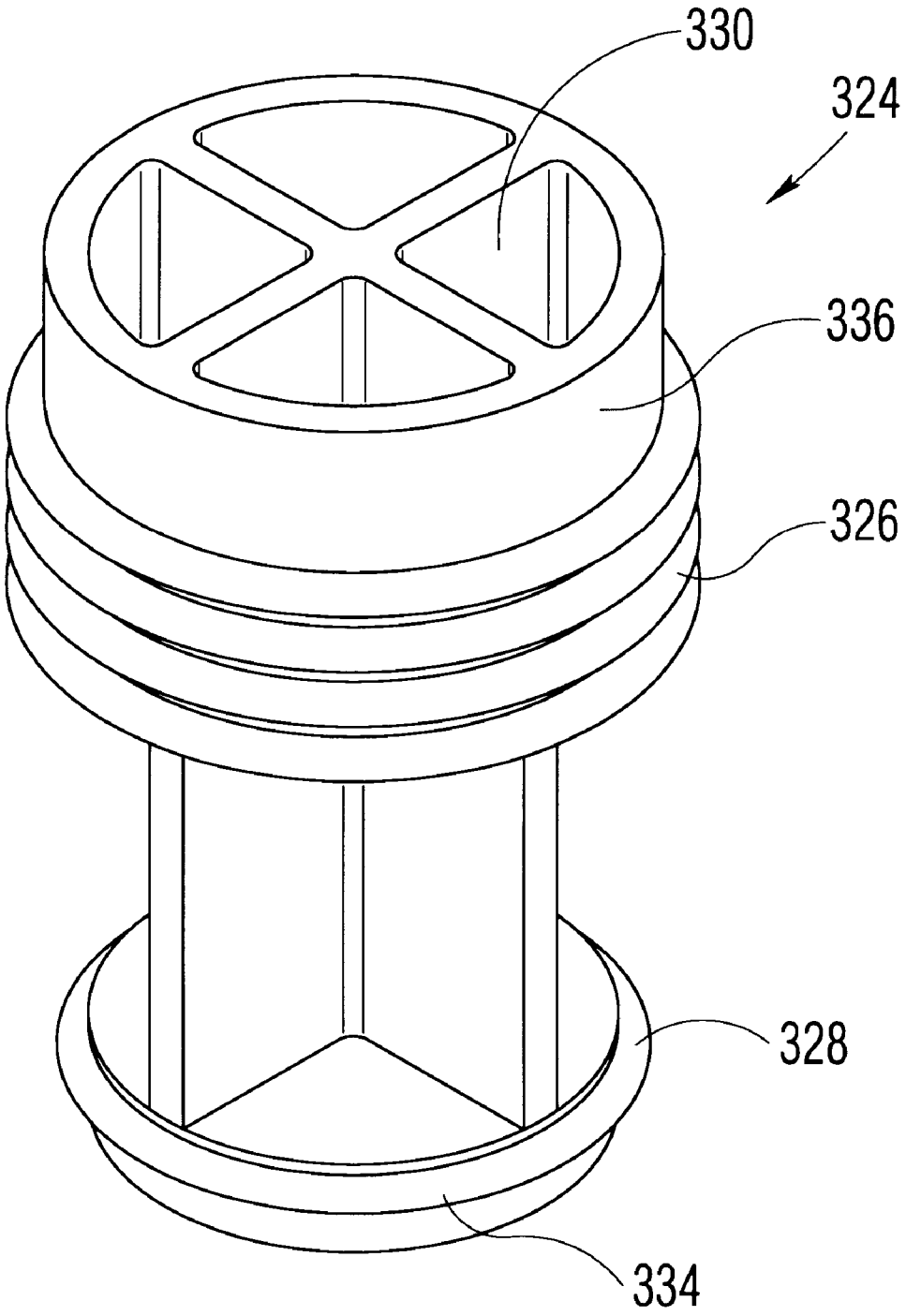
FIG. 8 is a schematic perspective view of the displaceable member of FIG. 6.

Two-compartment container 310 also includes a plug element or displaceable member 324 which is shown separately in detail in FIG. 8. Displaceable element 324 has a threaded part 326 for rotatably engaging threaded portion 322 and a partition wall 328 for sealing neck portion 318. Displaceable member 324 is formed such that, when it is rotated and threaded part 326 interacts with threaded portion 322, partition wall 328 moves from a non-sealing position (second state) as shown in FIG. 7 in which first and second compartments 314 and 316 intercommunicate to a sealing position (first state) as shown in FIG. 6 in which neck portion 318 is sealed.

Typically, partition wall 328 is formed to complement neck portion 318 and includes a resilient O-ring seal 334, formed from silicone rubber or the like, clipped between opposing pieces of a molded plastic assembly. Alternatively, planar or otherwise shaped abutment surfaces may be provided for sealing neck portion 318. The fluid-tight seal formed by the partition wall with the neck portion may be reformable, i.e. the two compartments are resealable. Alternatively, the partition wall and neck portion may be configured so that the seal is not capable of being reformed.

It is a preferred feature of certain embodiments of the present invention that displaceable member 324 also feature at least one conduit 330 for allowing introduction of a component through opening 320 into second-compartment 316 when displaceable member 324 is in its sealing position. The at least one conduit 330 is preferably circumscribed by threaded part 326 of displaceable member 324. Thus, displaceable member 324 as shown features a substantially cylindrical threaded part 326 with four conduits 330 separated by longitudinal radial walls. The longitudinal radial walls connect the partition wall 328 with the threaded part 326. Alternatively, the conduits may be formed peripheral to displaceable member 324 as flutes or channels in the threaded wall (not shown). Two-compartment container 310 in this case also includes a secondary seal 332 for sealing conduits 330. In a further alternative implementation of the present invention (also not shown), displaceable member 324 may be of a solid construction. In this case, a separate sealable opening is provided to allow filling and/or dispensing of second compartment 316.

It is a particular feature of some embodiments of the present invention that displaceable member 324 may be moved or rotated to selectively seal or unseal neck portion 318 from the outside of two-compartment container 310. To allow displaceable member 324 to be gripped for this purpose, displaceable member 324 may feature an upper wall section 336 extending beyond threaded part 326. Manual rotation of displaceable member 324 is facilitated by a flange member 338 which is attached around the outside of upper wall section 336. The assembly and filling procedure of two-compartment container 310 is essentially the same as that described with reference to bottle 10 and FIGS. 4–5.

Specifically for infant formula feeding applications, the two-compartment container preferably also serves as a feeding bottle. To this end, the two-compartment container is provided with a feeding nipple attached around the outside of the displaceable member. In the case of FIGS. 6 and 7, flange member 338 may be mounted externally to feeding nipple 340 and secondary seal 332 may be external to both. This allows secondary seal 332 to serve multiple functions, sealing second compartment 316, protecting the sterility of feeding nipple 340 and attaching to a shoulder of second compartment 316 so as to act as a tamper-indicating wrapping to ensure that flange 338 has not been twisted open.

Figure 9C:
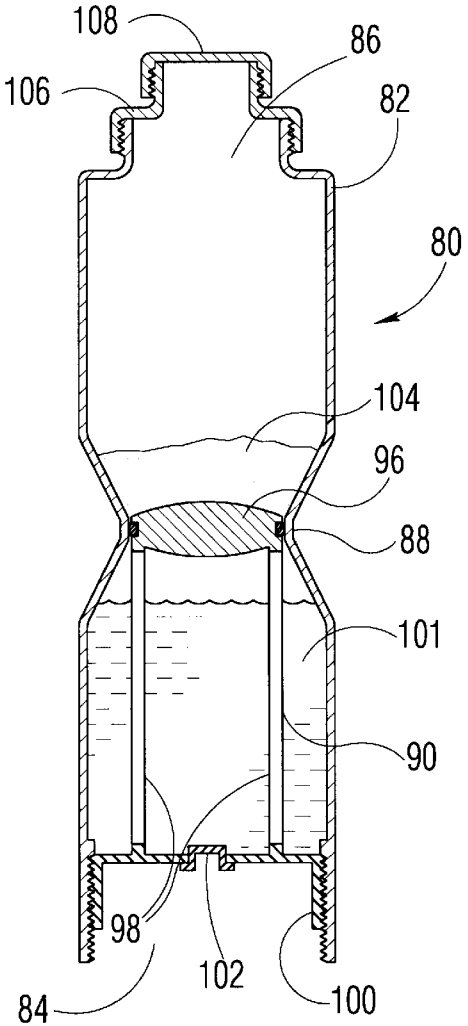
FIGS. 9A–9C show sequential steps in filling of a medicinal container in accordance with an embodiment of the invention.
Figure 9B:
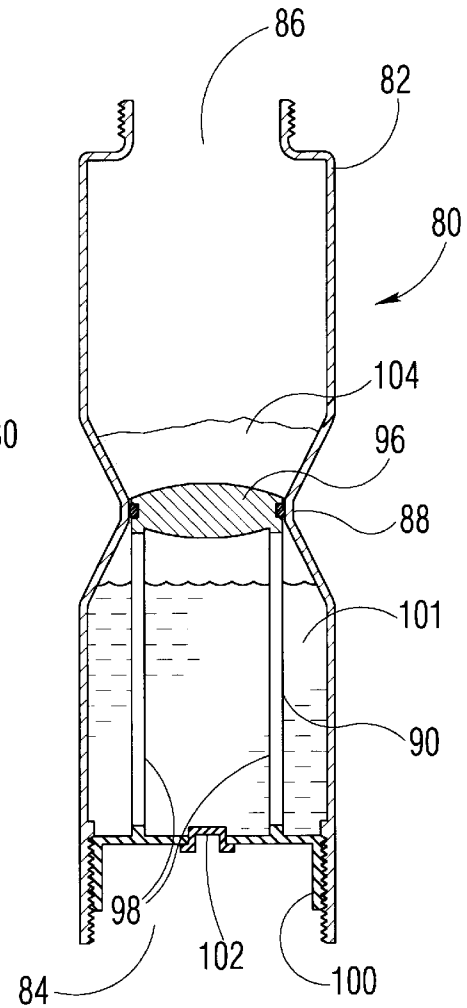
Figure 9A:
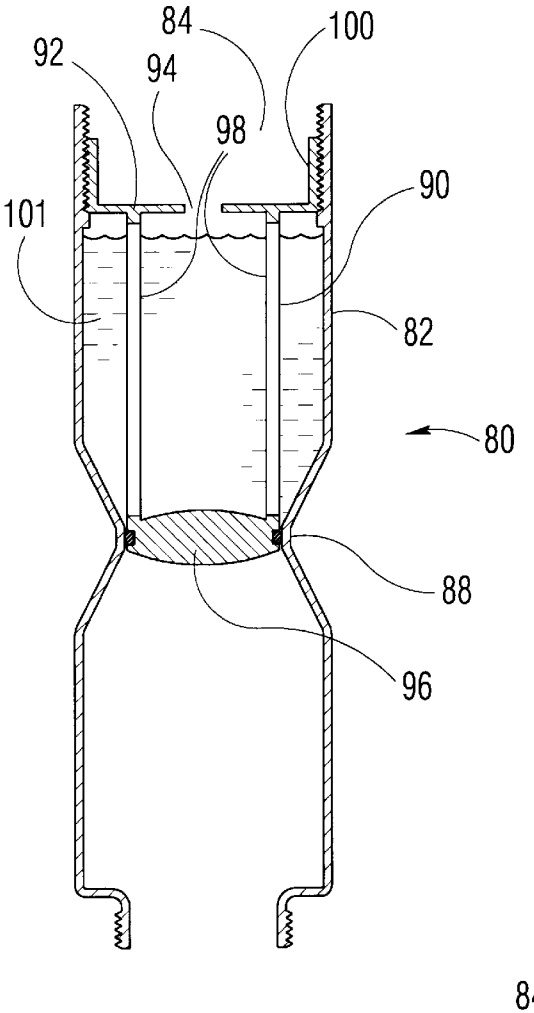

FIGS. 9A–9C show the construction and steps in filling of a two compartmental container 80 in accordance with a different embodiment of the invention. Container 80 is formed from a generally tubular body 82 with an opening 84 at an end of the body constituting the bottom of the container and a second opening 86 at an opposed top end. Intermediate between the top and bottom ends is a constricted neck portion 88. While containers 10, 310 and 80 have been formed with a constricted neck portion, the neck portions of these containers may also be formed as described with reference to FIG. 13.

Displaceable member 90, having an end wall 92 with a sealable filling aperture 94 and a partition wall 96 dependent from end wall 92 by stems 98, is fitted at end 84 by screw-threading at its peripheral portion 100. As a result of this screw-threading, the displaceable member 90 rotates causing axial displacement of partition wall 96 with respect to neck portion 88. After engagement of displaceable member 90 with body 82, and in particular partition wall 96 forming a fluid-tight seal with neck portion 88, a first component 101, e.g. water, is introduced through aperture 94, which is then sealed by stopper 102.

The container is then rotated into the position seen in FIG. 9B, with opening 86 facing upward. Then a second component 104, e.g. a powdered formula, is introduced through opening 86 which is then sealed by closure assembly 106. Closure assembly 106 may be provided with resealable closure 108.

Figure 10B:
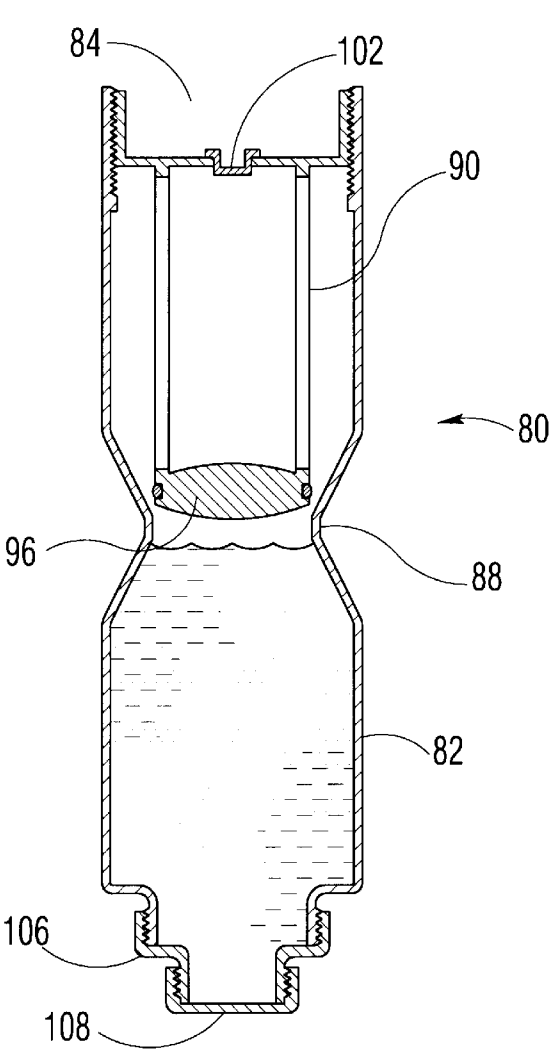
FIGS. 10A and 10B show steps in preparation of the formulation stored in the container of FIG. 9 for dispensing.
Figure 10A:
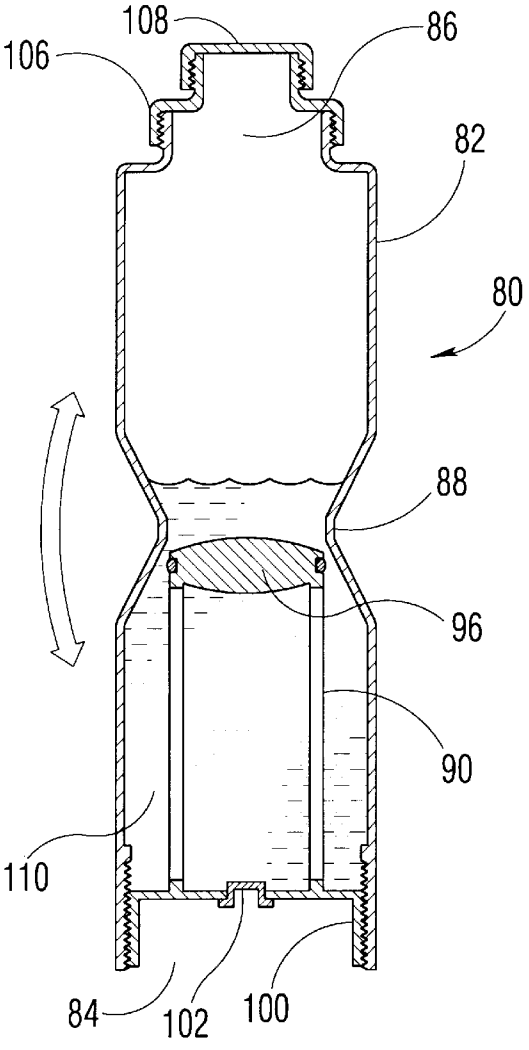

Preparing the container of FIGS. 9A–9C for use and dispensing of the formulation is shown in FIGS. 10A and 10B. In a first stage, shown in FIG. 10A, the displaceable member 90 is rotated such that partition wall disengages neck portion 88 to allow mixing of components 101 and 104 to yield liquid formulation 110. After mixing and homogenization, the container may be rotated for dispensing through closure 108 as shown in FIG. 10B.

Another embodiment of container 120 is shown in FIGS. 11A–11F. Container 120 is similar to container 80, shown in FIGS. 9 and 10, and so is its manner of filling, with a difference residing in assembly 122 which allows dosing of the liquid formulation 124.

Figure 11B:
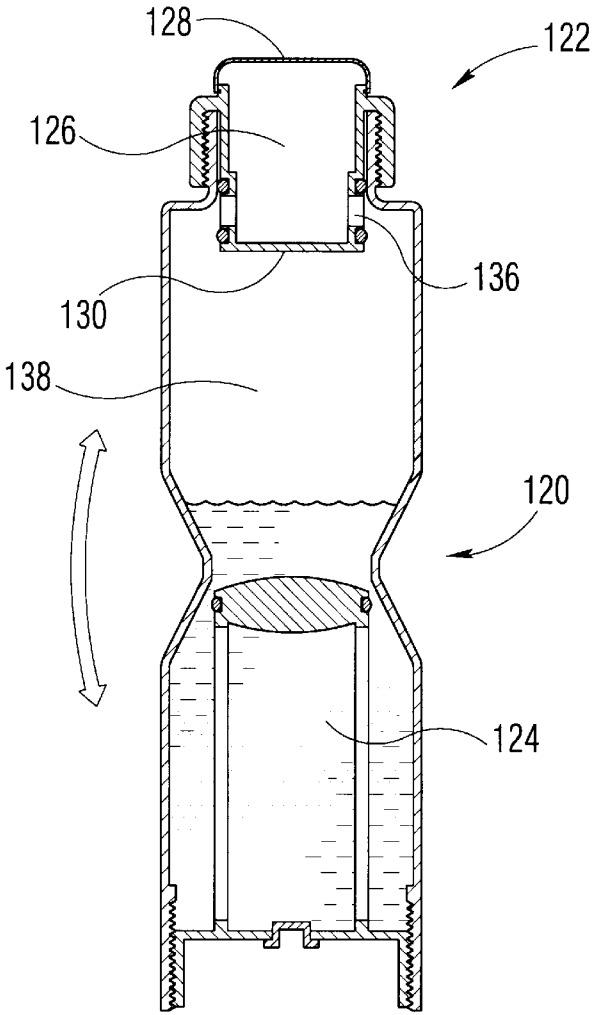
FIGS. 11A–11F show steps in preparation of a formulation for dispensing in a medicinal container in accordance with another embodiment of the invention, comprising a formulation dosing arrangement.
Figure 11A:
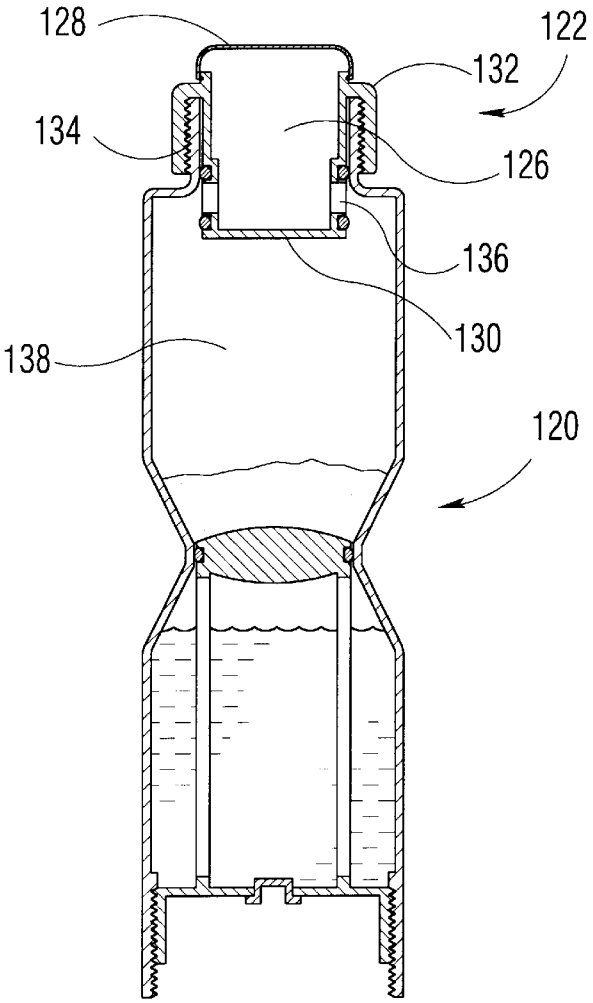
Figure 11D:
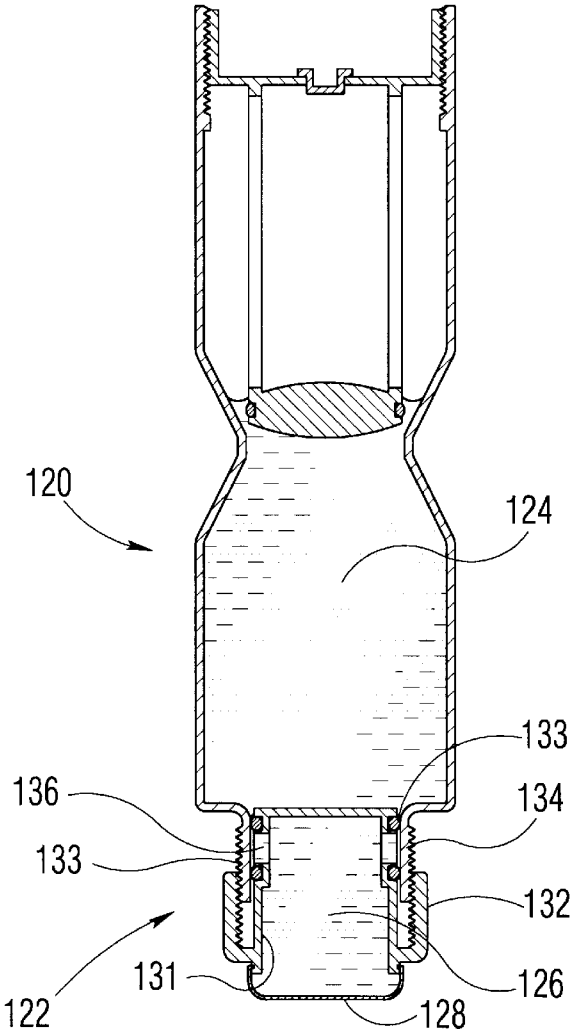
Figure 11C:
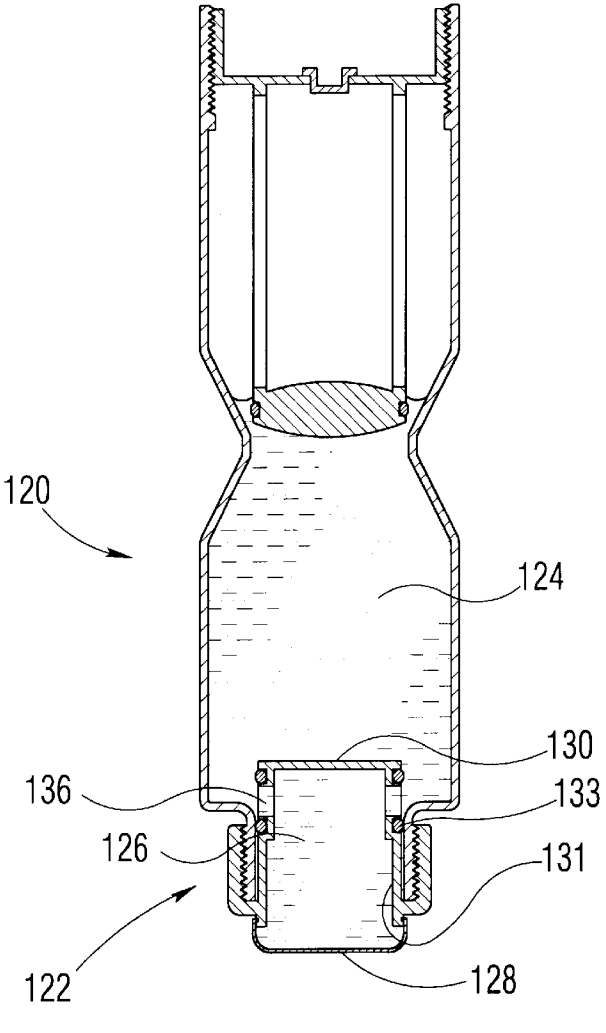

FIGS. 11A through 11F show different steps in the preparation and dispensing of the formulation. Assembly 122 defines a compartment 126 formed between a lid 128 and a bottom wall 130 of the assembly 122. Lid 128 forms a fluid-tight seal with the top end of the assembly. The assembly 122 has a skirt 132 which screw engages with screw thread 134 at the opening of container 120. The assembly further has openings 136 which in the position shown in FIGS. 11A–11C, provide for communication between compartment 126 and interior space 138 of container 120.

Figure 11F:
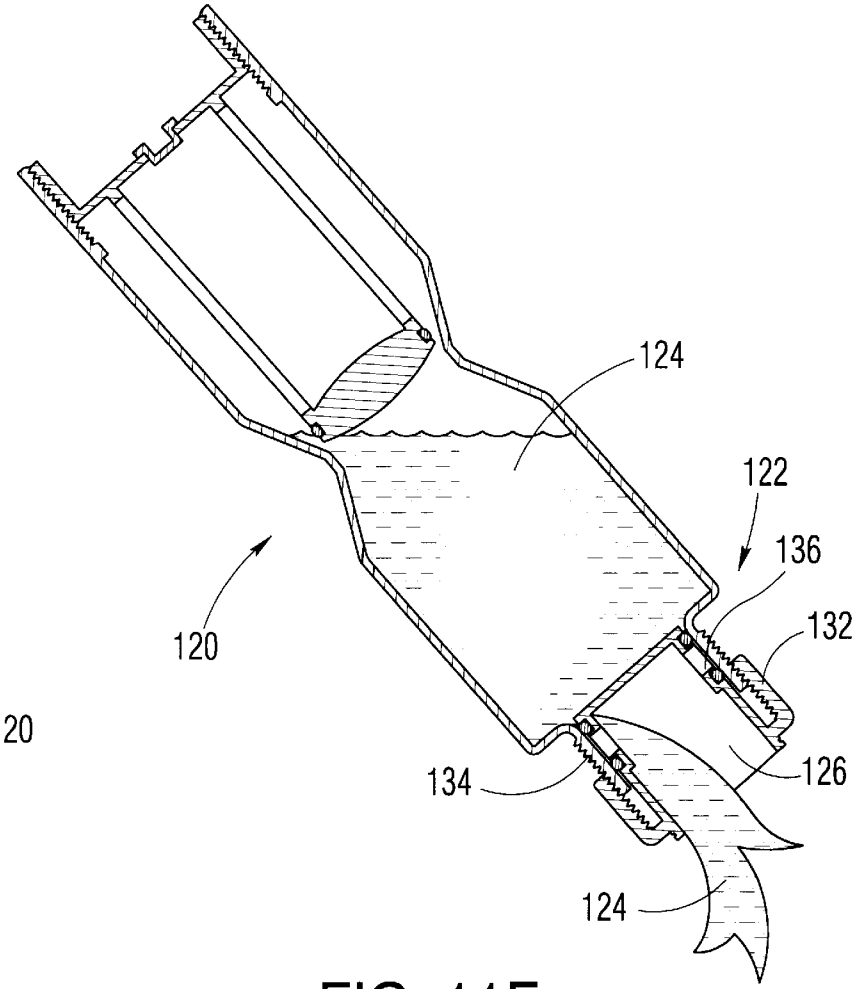
Figure 11E:
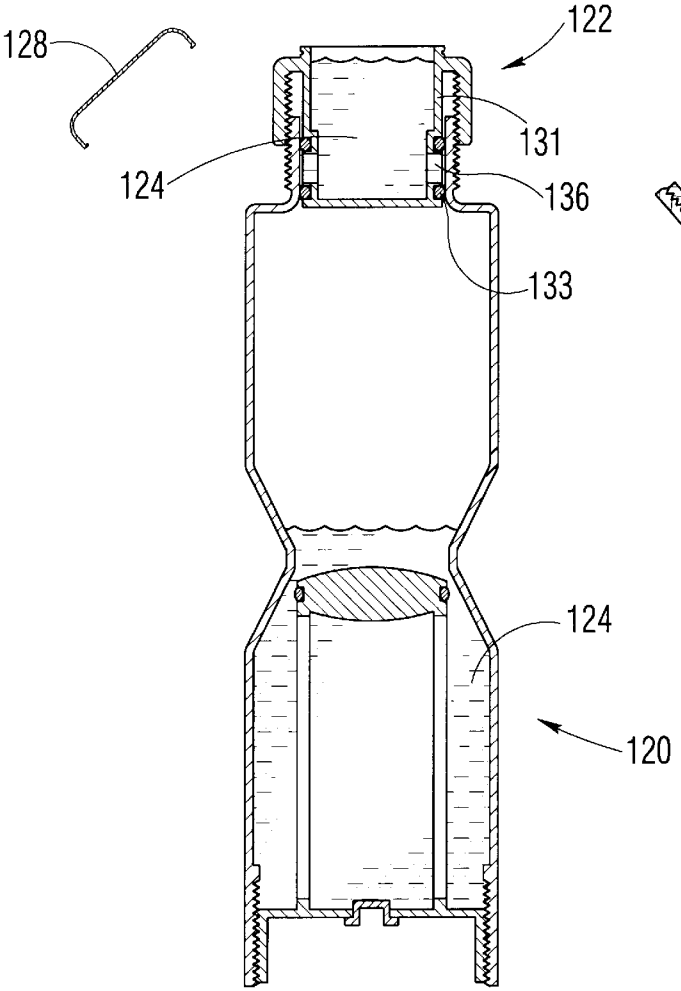

After mixing the two components, as shown in FIG. 11B, the container is rotated and consequently the liquid formulation fills compartment 126 through openings 136 (FIG. 11C). The assembly 122 is then rotated so that openings 136 are closed (FIG. 11D) and the container 120 can be turned upright (FIG. 11E). The side wall 131 of the closure assembly forms a reformable fluid-tight seal with the housing to prevent the liquid formulation or any of the separate components from leaking from the container. O-rings 133 may be provided to form or assist in forming the fluid-tight seal. Then the lid 128 can be removed and the contents of compartment 126 may be dispensed (FIG. 11F).

Another embodiment of a container 150 is shown in FIGS. 12A–12E. Here again, this container 150 differs from containers 80 and 120 in the nature of the closure and dosing assembly 152. The manner of dosing is shown in FIGS. 12A–12E.

The dosing assembly 152 has an end wall 155 with a depending skirt 153 along its peripheral edge which has screw threads 151 which engage cooperating screw threads 154 on the opening of container 150. End wall 155 has an aperture 156 which is fitted with a cylindrical central pipe 158. A fluid tight seal is provided between central pipe 158 and end wall 155 so that neither the components nor mixed liquid formulation leaks from the container. Central pipe 158 opens into and communicates with a dosing compartment 157. Compartment 157 is sized to hold an appropriate and predetermined amount of liquid formulation. The top side of compartment 157 is formed with a number of small holes 159 which are configured to allow the liquid formulation to enter and be trapped in the dosing compartment 157. Cap 149 is provided on central pipe 158 and provides a fluid tight seal.

Figure 12C:
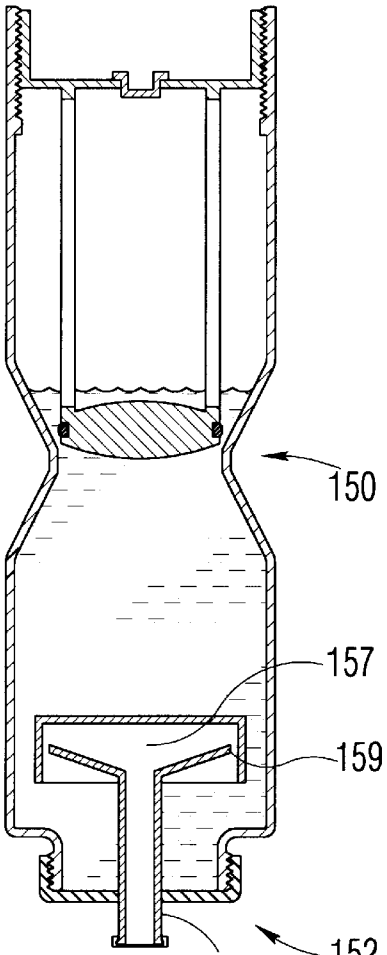
FIGS. 12A–12E show sequential steps in the preparation for dispensing of a medicinal formulation stored in a container in accordance with another embodiment of the invention, with a different dosing arrangement.
Figure 12B:
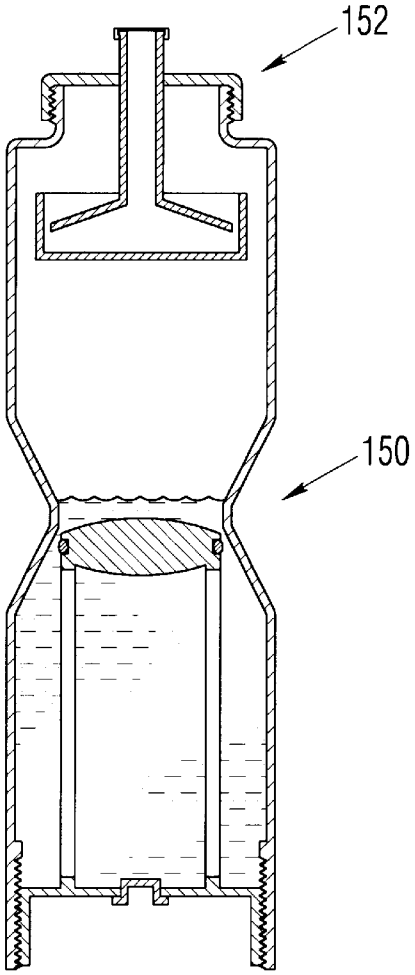
Figure 12A:
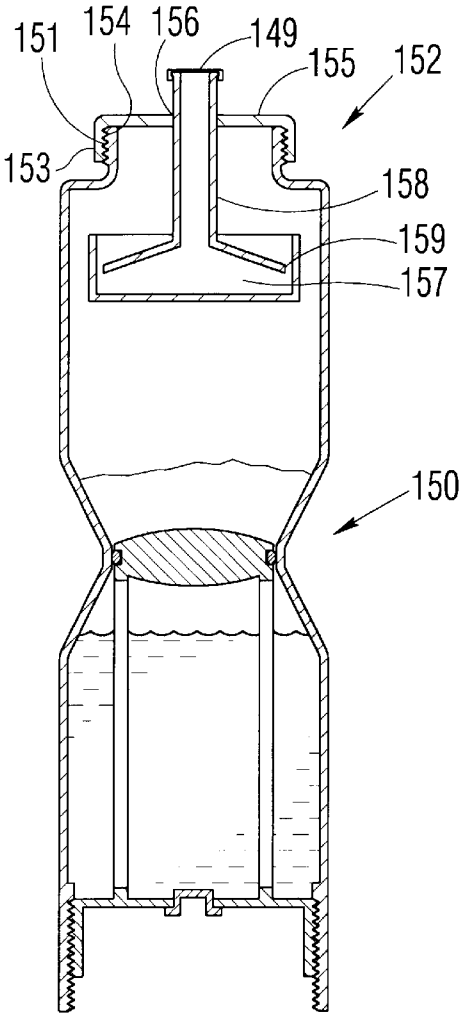
Figure 12E:
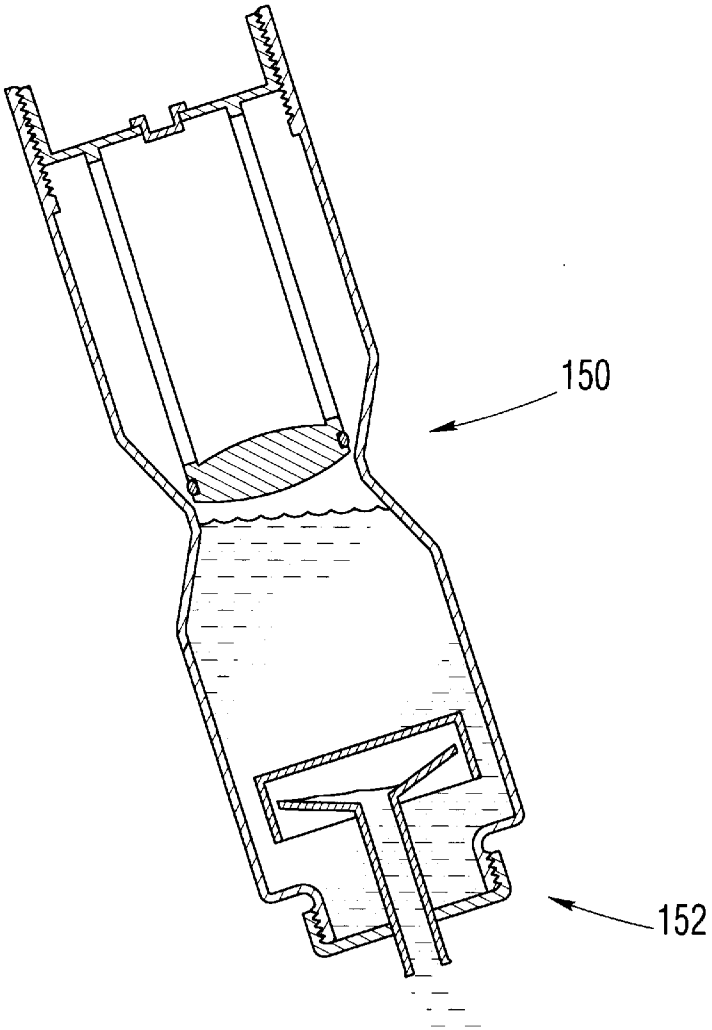
Figure 12D:
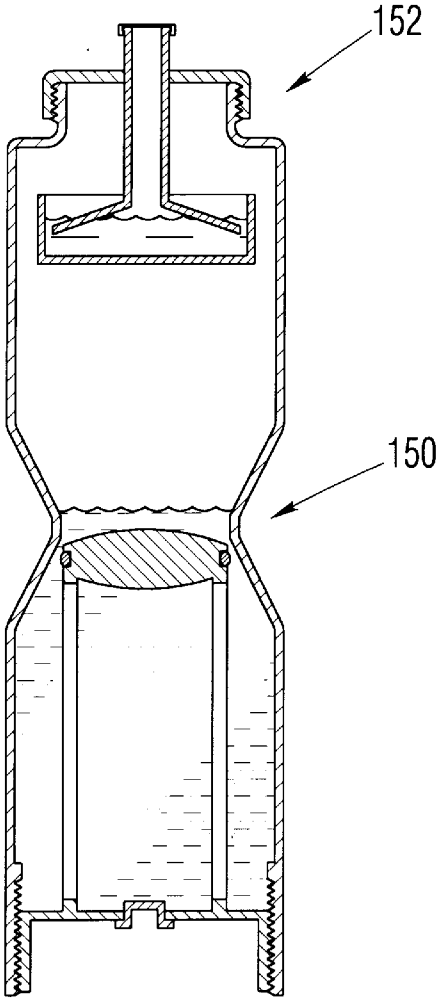

In FIG. 12A, the two-compartment container separately stores the two components, in this case a dry powder in the top compartment and a liquid in the bottom compartment, until the liquid formulation is to be prepared. When the liquid formulation is to be prepared, the displaceable member is moved so that the top and bottom compartments intercommunicate as shown in FIG. 12B. The entire container may be moved, such as for example, by shaking or agitating, to facilitate the preparation of the liquid formulation. In FIG. 12C, the container is turned upside down and the liquid formulation flows through small holes 159 into the dosing compartment 157. When dosing compartment 157 is full, the container is then turned back into its upright position as shown in FIG. 12D. Cap 149 is thereafter removed and the liquid formulation is dispensed through central pipe 158 as shown in FIG. 12E. Since central pipe 158 has a much larger cross section and opening than do all of small holes 159, the dosage amount in dosing compartment 150 is dispensed in FIG. 12D before small holes 159 allow additional liquid formulation into dosing compartment 157.

Figure 13C:
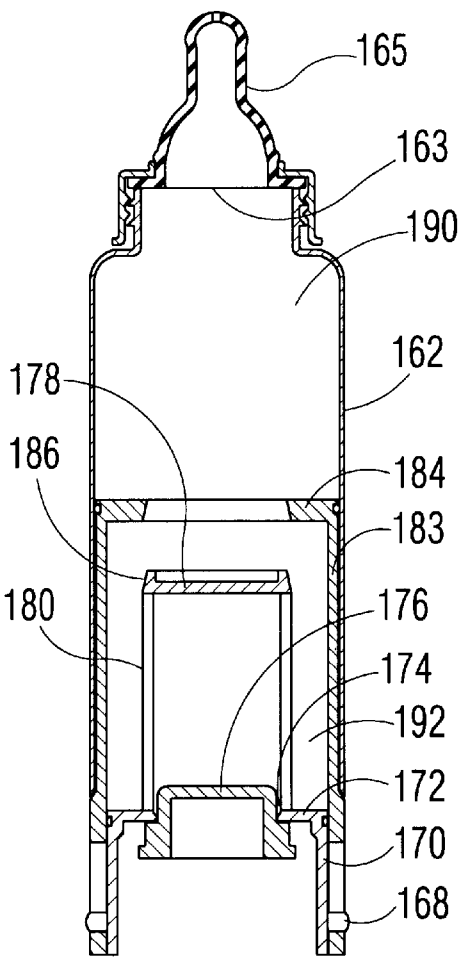
FIGS. 13B and 13C show a longitudinal cross-section through the bottle of FIG. 13A, where
Figure 13B:
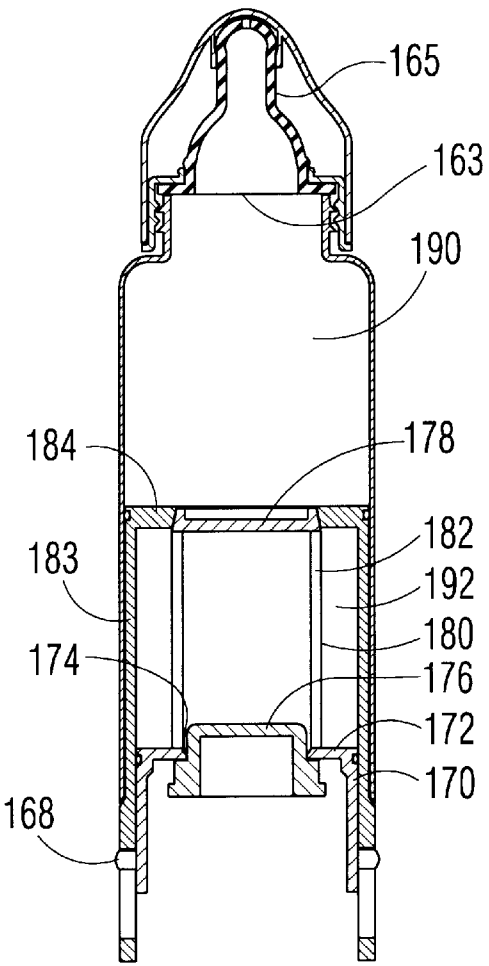
Figure 13A:
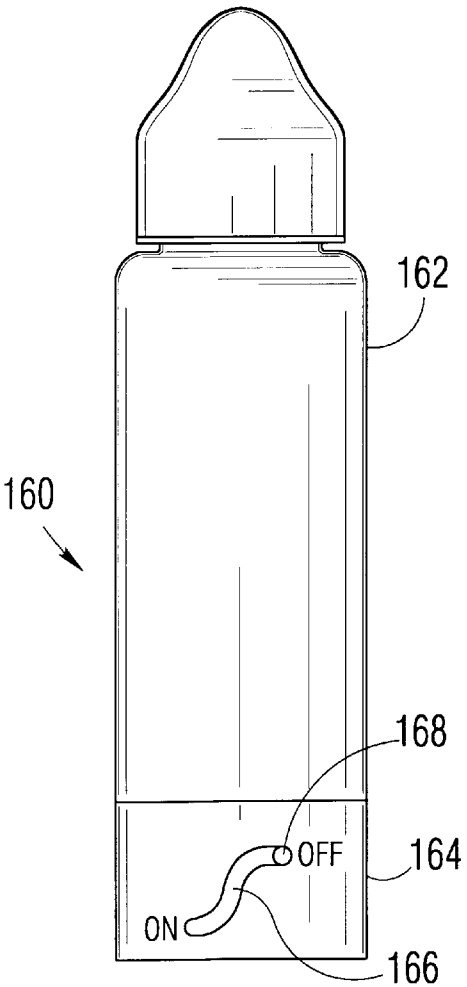
FIG. 13A shows a side view of a bottle in accordance with another embodiment of the invention.

Another embodiment of a container 160 is shown in FIGS. 13A–C as a baby's feeding bottle 160 having a body 162 and a bottom end 164. A displaceable member 170 is formed with a bottom portion 172 having a central opening 174 sealed by a stopper 176 and having a partition wall 178 connected to the bottom portion 172 by means of a cylindrical wall 180 formed with openings 182. Instead of a constricted neck portion, housing 162 has an inwardly extending radial wall 184 defining a neck portion 185 which cooperates with partition wall 178 to provide fluid-tight seal between a top compartment 190 and a bottom compartment 192 in the state shown in FIG. 13B. In FIG. 13, housing 162 accommodates a sleeve 183 which at its top end has inwardly extending radial wall 184 which cooperates with a sealing annulus 186 on partition wall 178 to form the fluid-tight seal. The seal may be reformable (i.e., it is resealable) or be constructed to form a seal which cannot be reformed after the partition wall disengages from the neck. The displaceable member is axially displaced to the position seen in FIG. 13C so that compartments 190 and 192 come into fluid communication with one another. The liquid formulation may then be mixed and dispensed through the nipple closure arrangement which may be constructed as described above or according to manners known in the art.

Bottom end 164 in FIGS. 13A–C is formed with a helical groove 166. Groove 166 slidingly accommodates a knob 168 which causes axial displacement of displaceable member 170 by rotation of the knob 168 between a first position, marked by the word "OFF", where the knob is positioned in FIG. 13A and 13B, and a second position, marked by the word "ON", seen in FIG. 13A. Details may be provided in groove 166 to retain knob 168 in either the "on" or "off" position.

Figure 14A:
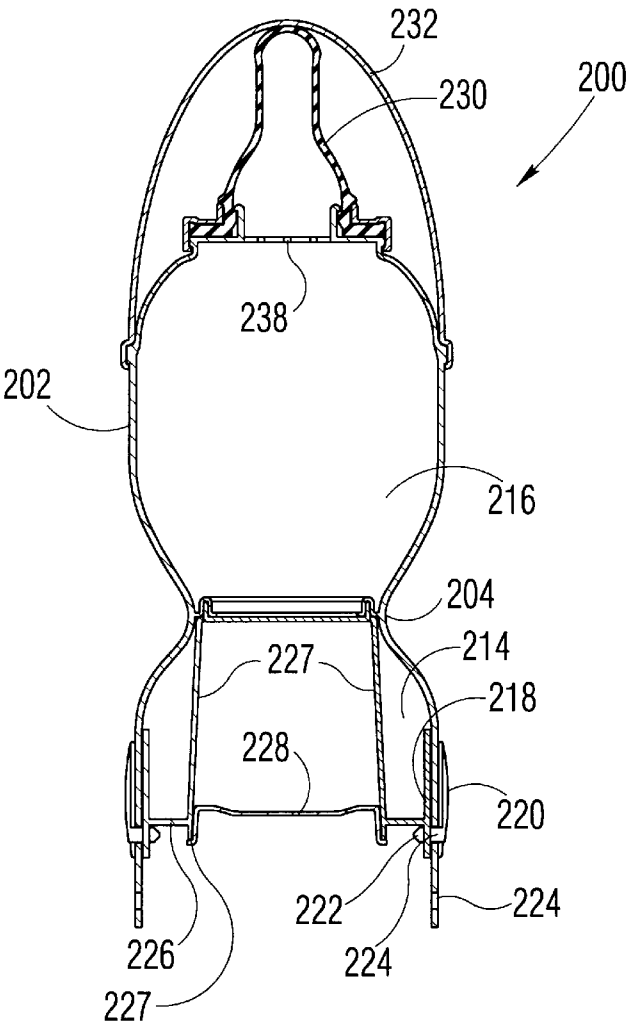
FIG. 14A is in a state where the two compartments are sealed from one another.
Figure 14B:
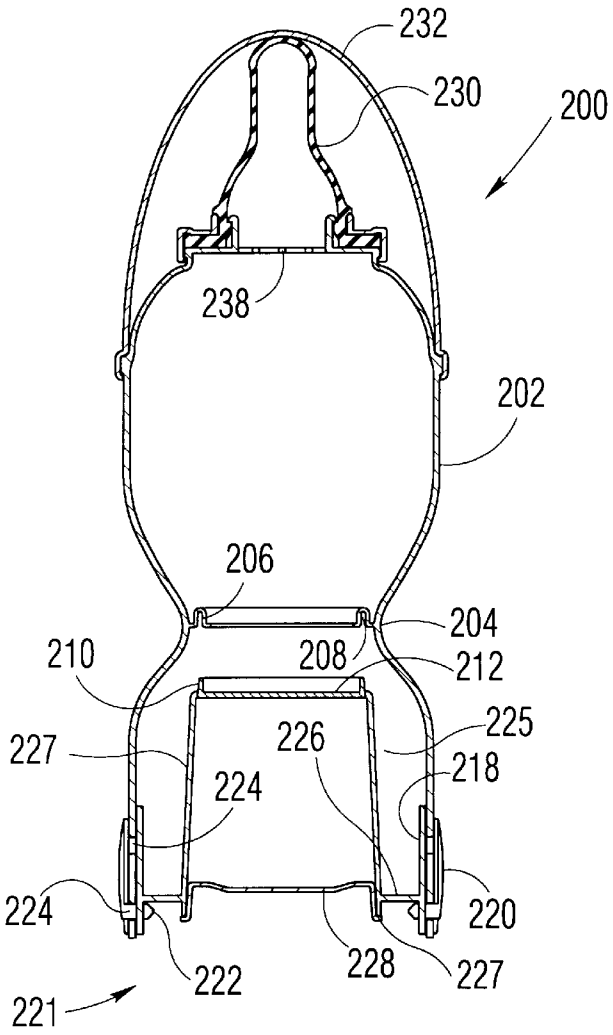
FIG. 14B is in a state where the partition wall is moved providing for communication between the two compartments.

A different embodiment of a baby's feeding bottle 200 is shown in FIGS. 14A–B having a housing 202 which is generally cylindrical and has a constricted neck portion 204. Inwardly projecting from neck portion 204 is an annular engagement member 206 formed with a downwardly-facing groove 208 which cooperates with an annular projection 210 projecting from a partition wall 212 to provide a fluid-tight seal between a bottom compartment 214 of the container and a top compartment 216 as shown in FIG. 14A. The partition wall 212 forms part of a displaceable member 218 which has a user manipulable portion 220 with two pins 222 accommodated within a helical groove 224. By rotation of the user manipulable portion 220, the displaceable member is axially displaced downwardly to the position shown in FIG. 14B.

The displaceable member further has a bottom portion 226 having an opening sealed with a stopper 228. The partition wall 212 is connected to the bottom portion 226 by a cylindrical wall 225 having openings 227. The stopper 228 allows a component, e.g. powdered baby formula, to be introduced into a bottom compartment 214. The baby's feeding bottle 200 has an opening 238 fitted with a nipple 230 with the nipple being protected by a cover 232 which may be attached to the housing by a snap fit or cooperating threaded portions. The top compartment 216 in the embodiment of FIGS. 14A and 14B is specifically sized to store the liquid and/or fluid substance while the bottom compartment 214 is sized to store the dry substance. It is envisioned that certain advantages and better mixing may result from the liquid and/or fluid being added to the dry substance in the lower compartment. For example, storing the powder in compartment 216 can lead to blockage of the nipple by undissolved powder.

Figure 4C:
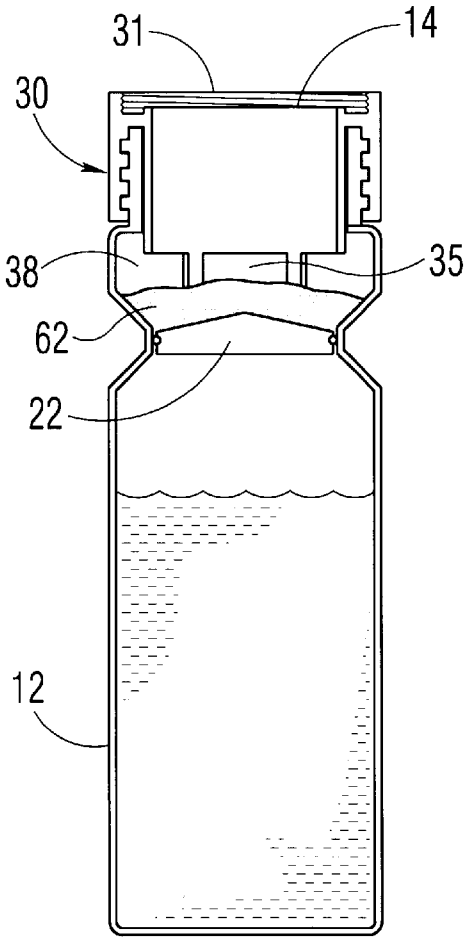
FIGS. 4A–4E show sequential steps in filling the baby's feeding bottle of the invention with two separately stored components, a liquid component and a powdered formula.
Figure 4B:
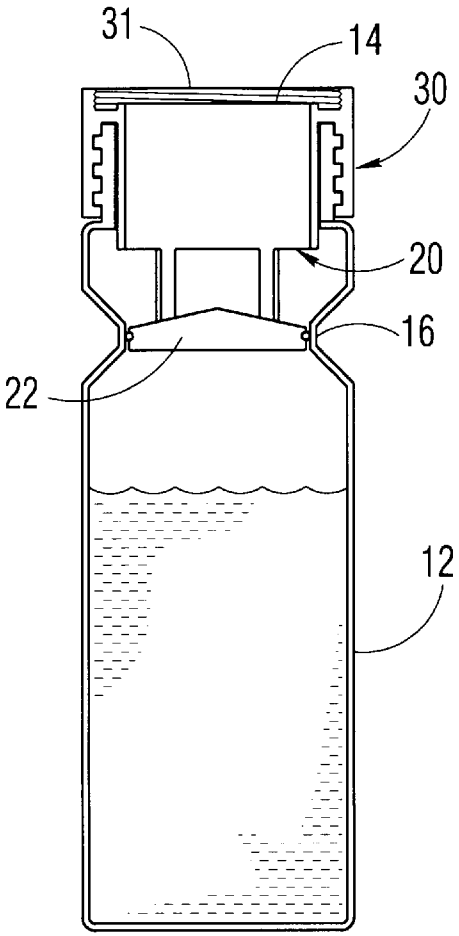
Figure 4A:
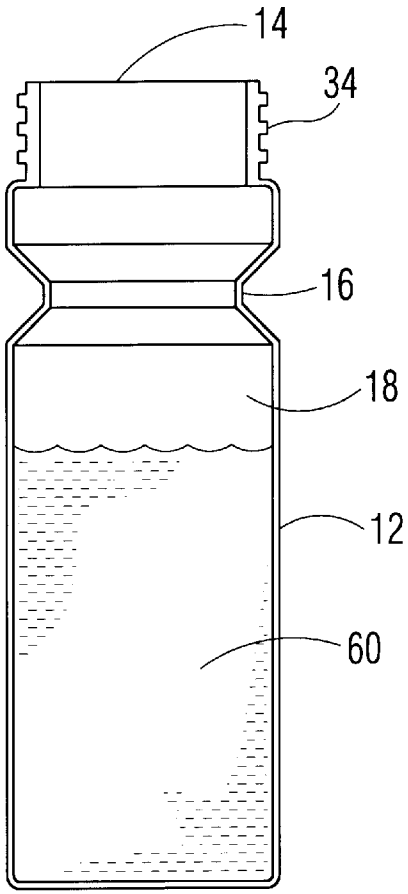
Figure 4E:
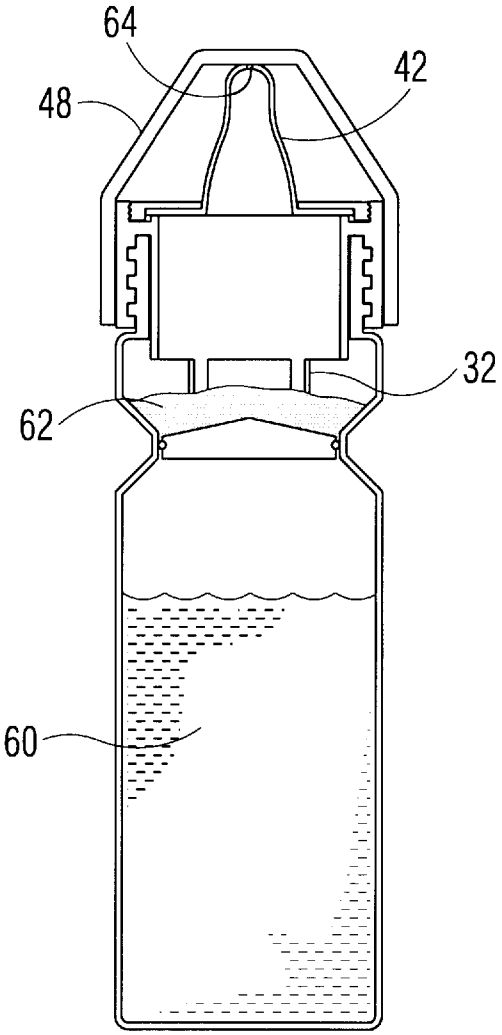
Figure 4D:
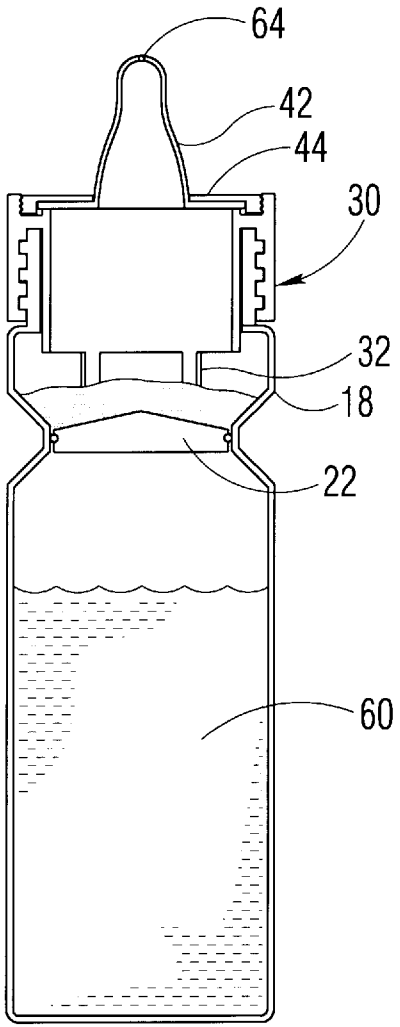

In FIG. 4C an exploded version of FIGS. 4A–B is shown. Housing 202 is constructed by assembling main tank 250, having neck portion 204 and inwardly projecting annular engagement member 206, with nipple seat 260 by ultrasonic welding so that main tank 250 and nipple seat 260 form fluid tight compartment 216. The opening 238 in the top end of the housing 202 is fitted with nipple 230 which is held in place by a nipple clamping ring 240. The nipple clamping ring 240 mates with a shoulder 234 formed on the nipple 230 and is held in place by proturbences 236 formed on the nipple 230 and by lip 262 formed on nipple seat 260. The nipple clamping ring 240 couples the nipple 230 to the container by being snap fitted over lip 262.

The assembly of nipple 230 on housing 202 with nipple clamping ring 240 is designed so that the container is for a single use. For example, nipple clamping ring 240 can be designed to snap onto lip 262 in a manner so that if the ring is removed, it cannot be refastened to the container. Alternatively, or in addition to, nipple clamping ring 240 can be designed so that it cannot be removed after it has been snap fit into place on the nipple seat 260. Other attributes of the container which make it particularly adaptable for a single use are its materials and ease of construction, and the thickness of materials used.

Figure 14C:
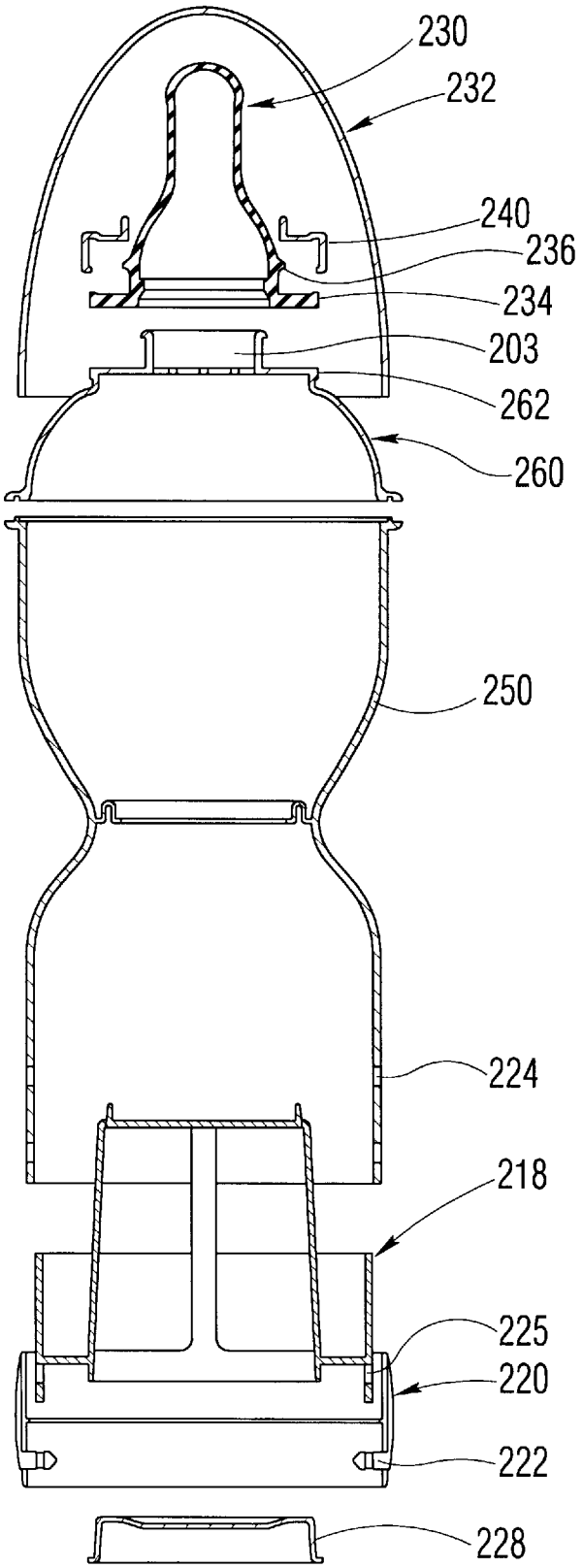
FIG. 14C is an exploded view of the container of FIGS. 14A and B.

FIG. 14C also shows displaceable member 218 with manipulable ring portion 220. Displaceable member 218 is inserted within the bottom end of housing 202 and manipulable portion 220 is fitted over the bottom end of the housing 202 and positioned so that pins 222 are insertable within helical groove 224 and are snap fit through apertures 225 in displaceable member 218 to attach the manipulable portion 220 to the displaceable member. Depending upon whether the container is for a single use or multiples uses the seal formed by the annular projection 210 (on partition wall 212) and groove 208 (on annular engagement member) can be designed to form a one use seal or a reformable seal (i.e., resealable). In some applications it may be desirable to have the container specifically constructed for a single use so the sterility of the container (and nipple arrangement) and the correction proportions, sterility and quality of the components are ensured. In the embodiment of FIGS. 14A–C the annular projection 210 and groove be configured and adapted for a single use such as by, for example, ultrasonically welding the two together wherein the welded joint pulls apart upon movement of the displaceable member 218. The annular projection and groove may also be configured and adopted to be resealable, that is, the seal can be broken and reformed by movement of the displaceable member.

It will be appreciated that filling of the container of FIGS. 13 and 14, their preparation for use and dispensing is similar to the embodiment described in FIGS. 9A–C and 10A and B.

Figure 15:
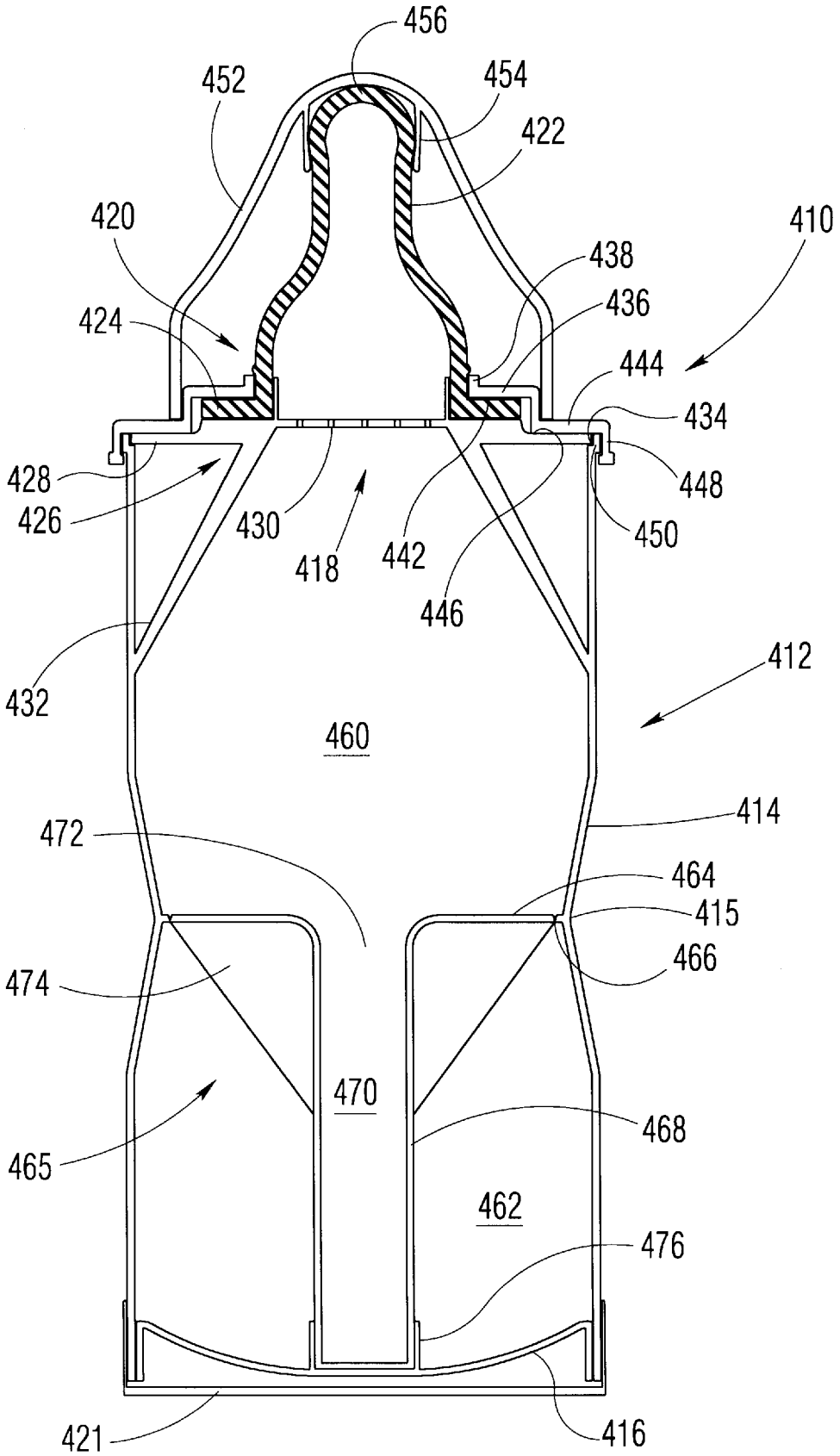
FIG. 15 shows a longitudinal cross-section through a two-compartment container in accordance with baby's feeding bottle embodiment of the invention.

A baby's feeding bottle 410 according to another embodiment of the invention is shown in FIG. 15. The container comprises a housing 412 of a general cylindrical shape with side walls 414, a bottom wall 416 and an opening 418 at its top fitted with a closure assembly 420. Fixed at the bottom end of the container is a tamper-resistant cover 421, the function of which will be explained further below.

Closure assembly 420 comprises a nipple 422, typically made of silicon rubber, latex rubber or any other FDA approved material adaptable for such purposes, having an annular skirt 424, mounted on a sealing member 426 having an annular portion 428 defining a central aperture 429 fitted with a sieve element 430 for filtering out undissolved food particles from the liquid formula, and having an upwardly extending cylindrical annulus 431 supporting the bottom inner face of nipple 422 and slanted support structure or legs 432. The edges of annular portion 428 are received in peripheral circumferential shoulder 434 at the top end of side walls 414 and the end of support structure 432 rests on the inner face of side walls 414. The nipple is held by an engagement member 436 having generally a stepped cross-sectional shape. The engagement member 436 has a first horizontal portion 442 pressing on skirt 424, a second annular horizontal portion 444 resting in peripheral recess 446 of seat member 426, and a peripheral downward extending portion 448 snappingly engaging shoulder 434 by means of annular bulge 450. This manner of engagement by means of engagement member 436 ensures a fluid tight attachment of the closure assembly 420 to opening 418. The fluid tightness of the engagement may at times be improved by the use of a rubber annulus placed below horizontal portion 444, etc.

As described with reference to FIGS. 14A–C, the nipple assembly can be configured and adapted so that the container is particularly suited for a single use, such as by for example, designing the engagement member to be unremovable or not capable of being refastened.

As can further be seen in FIG. 15, closure assembly 420 is fitted with cover 452 having a downward projecting cup member 454 receiving the top end of nipple 422 thus sealing its opening 456.

The container has two compartments, a top compartment 460 and a bottom compartment 462 separated by a partition wall 464 integrally connected to side walls 414 through annular connecting zone 466. Extending downward from partition wall 464 is an elongated connecting member 468 having a hollow cavity 470 with an opening 472 at its top end and having reinforcing ribs 474. The bottom end of elongated member 468 is received by and connected to a cup member 476 projecting upwards from bottom wall 416.

Partition wall 464 provides a fluid tight separation between compartment 460 and 462. Upon vertical displacement as a result of upward pushing of bottom wall 416, the connecting zone 466 breaks thereby unifying the two compartments and allowing mixing of their contents. The seal formed in this embodiment by partition wall 464 is not reformable and the container is particularly adapted for a single use. In order to avoid accidental displacement of bottom wall 416, it is covered by tamper-resistant cover 421 which has to be removed to allow pushing of bottom wall 416. The tamper-resistant cover 421 may be removably attached by use of snap-fit arrangement, by screw coupling, by a tearable attachment zone, etc. Alternatively, the tamper-resistant cover may also be a foil or a film removable prior to use.

Figure 16C:
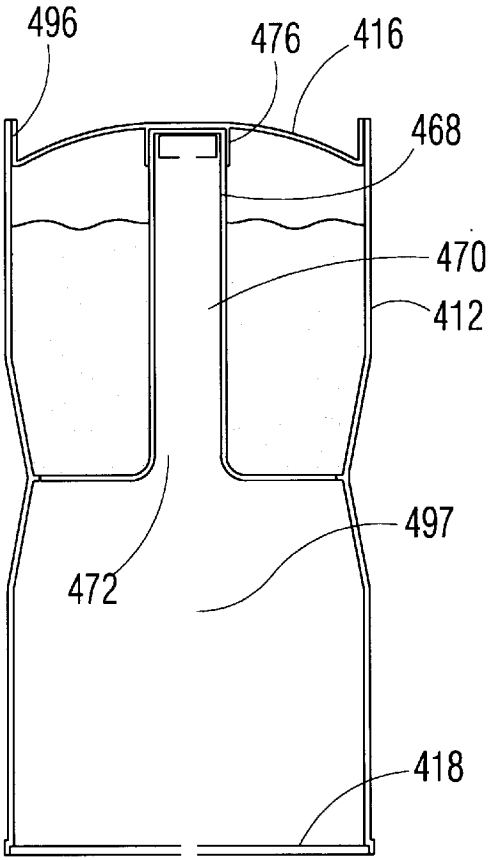
FIGS. 16A–16F illustrate the manner of filling of the baby's feeding bottle of FIG. 15 to store different components of a baby's formulation one in each compartment, and then breaking the partition wall between the compartments and mixing the two components to form the formulation prior to use.
Figure 16B:
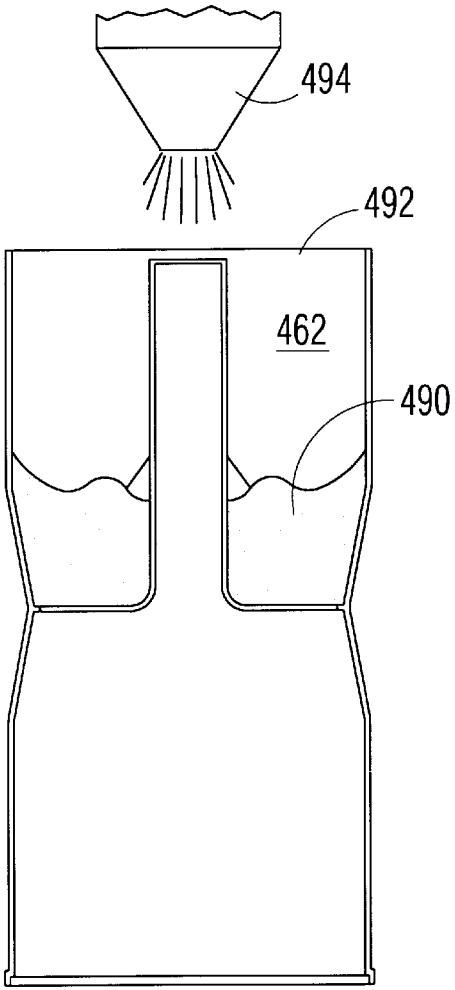
Figure 16A:
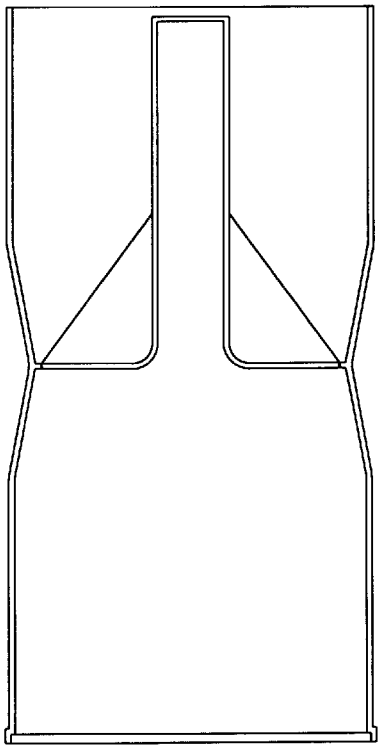

FIGS. 16A–16E illustrate the manner of preparation of the container, so that each compartment contains one component of a baby's feeding formula, e.g. powdered formula in the bottom compartment 462 and water in the top compartment 460. However, this may obviously be reversed, i.e. the powdered formula at the top and water at the bottom. The container is typically provided initially in the manner shown in FIG. 16A without bottom wall 416 and closure assembly 420 and placed inverted. At a first step, shown in FIG. 16B, compartment 462 is filled with a dry powdered formula 490 introduced through the open end 492 via a dosing dispenser 94. At a next step, shown in FIG. 16C, the bottom wall 416, having a concave shape within annular skirt portion 496, is mounted over the open end 492 of the container and attached thereto. Preferably, the annular skirt portion 496 is attached to the internal face of wall 412 by sonic welding, although other forms of adherence are also possible such as gluing, or heat welding, etc. Cup member 476 is then fixed to a bottom end of elongated member 468 by sonic welding typically performed by inserting a probe 497 through opening 418 of the container and opening 472 of cavity 470.

Figure 16F:
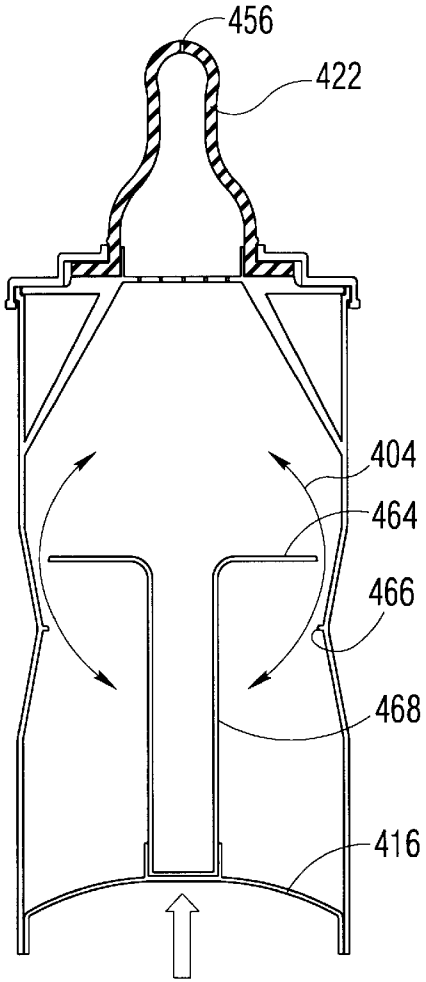
Figure 16E:
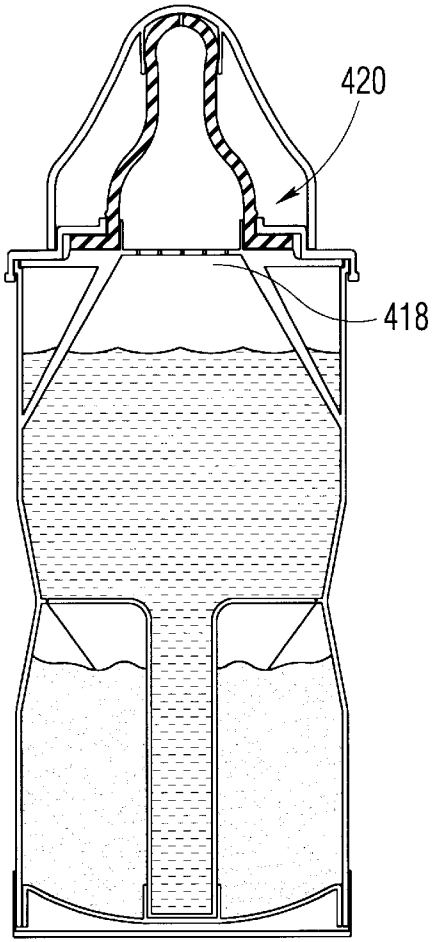
Figure 16D:
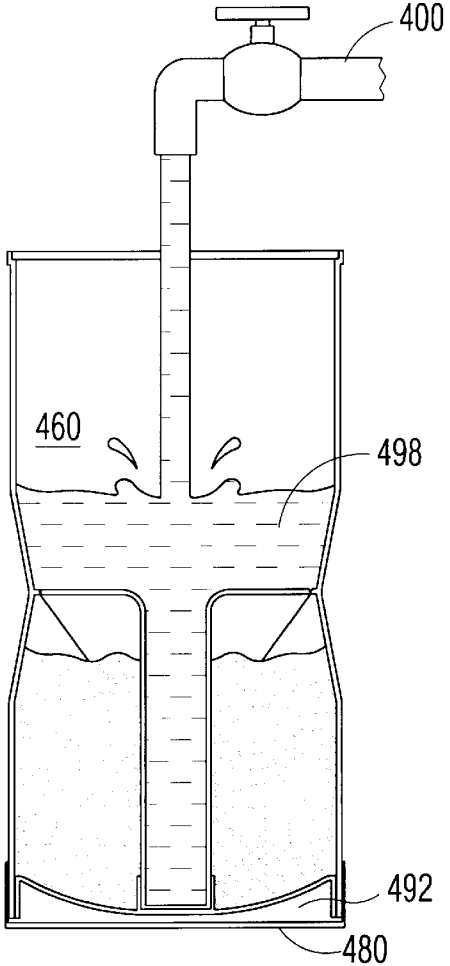

In the next step of preparation, shown in FIG. 16D, a tamper-resistant cover 480 is mounted over end 492 and the container is turned into its upright position and liquid (typically water) 498 is introduced into compartment 460 through a dispensing tap 400. Then, in a next step, shown in FIG. 16E, the closure assembly 20 is fitted over opening 418.

Preparing the container for use is shown in FIG. 16F. Prior to use, the tamper-resistant cover 480 is removed from the bottom end of the container and force is applied in a vertical direction on bottom wall 416, as represented by arrow 404, causing the wall 416 to assume the position seen in FIG. 16F, yielding a vertical axial displacement of elongated member 468 and partition wall 464. This tears or breaks the partition wall 464 at the connecting zone 466 whereby the contents of the two compartments can be mixed (represented by arrows 404). After mixing, the formulation is ready for use and dispensing through opening 456 of nipple 422 after removal of cap 452.

Figure 17:
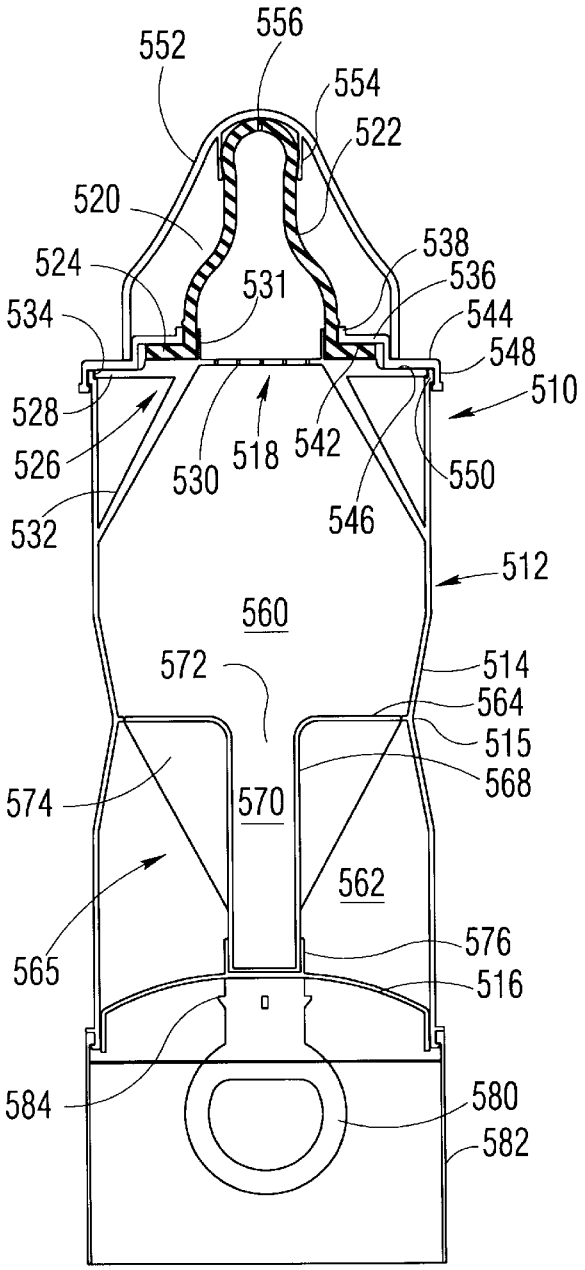
FIG. 17 is a longitudinal cross-section through a baby's feeding bottle in accordance with another embodiment of the invention.

Reference is now being made to FIG. 17 showing a baby's feeding bottle 510 in accordance with another embodiment of the invention. This embodiment is in essence similar to the embodiment shown in FIG. 15 with all like elements given a reference numeral with the two last digits being the same as the corresponding element in FIG. 15. In distinction from the bottle of FIG. 15, the bottom wall 516 in FIG. 17 is upwardly arcuated having integral handle 580 confined within a space defined by the bottle's base member 582.

Figure 18:
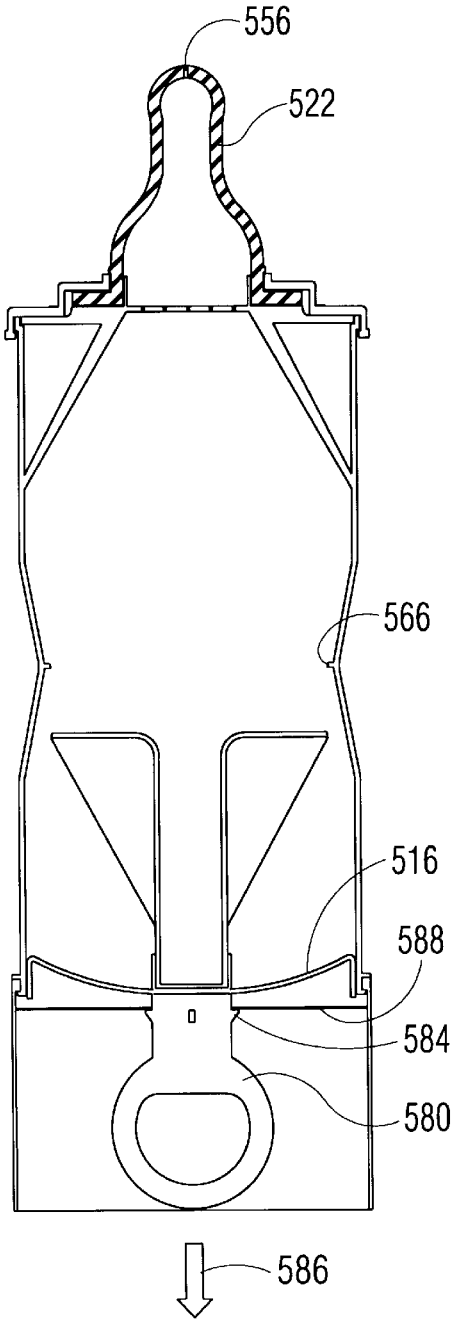
FIG. 18 shows a baby's feeding bottle of FIG. 17 in use when mixing the two components into final formulation and preparation for use.

As shown in FIG. 18, when the handle 580 is pulled downward in the direction of arrow 586, wall 516 becomes downwardly arcuated with the displacement causing breaking or tearing of connecting zone 566 allowing mixing of the contents of the two compartments, similarly as in the embodiment of FIGS. 15 and 16. Handle 180 has several engagement teeth 584 which serve, as can be seen in FIG. 17, for engagement with accessory wall 588, to hold a bottom wall 516 in the downward-arcuated position. Once the contents of the two compartments have been mixed, and a ready-to-use formation is formed, it can be dispensed through opening 556 of nipple 522 after removal of cap 552.

It should be appreciated that the present invention may be used to advantage for a wide range of implementations of two-compartment containers. Possible implementations include, but are not limited to, food, beverage and pharmaceutical applications, and may employ two liquid components or one liquid and one solid component. It further should be appreciated that in some embodiments the invention may also be particularly directed toward single use, pre-packaged two or more compartment containers which are easily and inexpensively constructed and filled so as to be disposable.

The container may also feature accessories specific to a given application for dispensing of the final mixture. Possibilities include, but are not limited to, feeding devices designed for infants or geriatrics and measuring cups or other devices for dispensing measured units for medicines and the like. By way of example only, the present invention has in some examples been illustrated herein with respect to an infant formula feeding bottle structure and in other examples to a dairy assembly.

It is significant to note that the containers of the present invention may be filled under a wide range of controlled conditions suited to a wide range of applications. The entire assembly process may be performed under sterile conditions and may use sterilized components and ingredients. In addition, one or both of the compartments, and particularly the compartment containing a powdered ingredient, may be partially evacuated. Alternatively, or additionally, an inert gas such as Nitrogen may be introduced, either above or below atmospheric pressure, to minimize oxidation of the contents during storage. Other special environmental conditions such as controlled humidity may also be employed as required.

In cases such as infant formula in which the mixture may need to be warmed to ensure dissolution or for dispensing, the two-compartment container may be made entirely of non-metallic materials to allow direct heating of the contents in a microwave oven. Alternatively, or in addition to, the two-compartment container may be made entirely of materials to allow heating of the contents by placing the container in boiling or heated liquid such as water. Many materials may be used in the construction of the different embodiments of the invention including plastics such as, for example, polypropylene. The feeding nipple and portions of the partition wall may be made of silicon rubber. When used to store or dispense medicines and food, it is contemplated that the materials of the container meet regulatory standards such as provided by the United States Food and Drug Administration and other regulatory authorities.

It will be appreciated that the above descriptions are intended only to serve as examples, and that many other embodiments are possible and encompassed within the spirit and the scope of the present invention.

We claim:

1. A two-compartment container for separately storing two components, mixing the components and dispensing a formulation formed by mixing the two components comprising:

(a) a housing having an opening at each of its top and bottom ends and a neck portion located between the top and bottom ends dividing the housing into top and bottom sections;

(b) a top sealing member communicating with the top end opening of the housing for sealing the top end opening of the container;

(c) a displaceable member having a partition wall at a first end which is configured and adapted to form a seal when it engages the neck portion, a manipulable portion adapted and configured to be controlled by a user to move the displaceable member, and at least one connecting member extending between the partition wall and the manipulable portion; and (d) a closure member sealing the bottom end opening;

wherein the displaceable member is movable between a first position where the partition wall is located within a neck portion forming a seal and a common wall which divides the housing into two separate fluid-tight compartments and a second position where the partition is removed from the neck portion so that the two sections can intercommunicate.

2. A container according to claim 1, wherein said neck portion has a circular cross-section and said partition wall is circular.

3. The container according to claim 1, wherein the neck portion comprises a radially inwardly extending wall from the housing.

4. A container according to claim 1, wherein the one or more connecting members are longitudinal radial members.

5. A container according to claim 1, wherein the partition wall forms a fluid-tight seal by engaging the internal walls of the neck portion.

6. A container according to claim 1, further comprising an unremovable top sealing member to prevent access to either one of the first or second compartments.

7. A container according to claim 1, further comprising a top sealing assembly which cannot be refastened after its removal to prevent the contents of the refilled container from being properly dispensed.

8. A container according to claim 1, further comprising a means for dispensing the liquid formulation to a baby.

9. A container according to claim 1, wherein the top sealing member is exterior to a feeding nipple to seal the opening in the feeding nipple.

10. A container according to claim 1, wherein the displaceable member is disposed within the bottom end opening.

11. A container according to claim 10, wherein the displaceable member has a passageway so that the interior of the container communicates with the exterior of the container.

12. A container according to claim 1, wherein a passageway is formed in the displaceable member to allow material to be added to or removed from the container.

13. A container according to claim 12, wherein the passageway communicates with the bottom end opening.

14. A container according to claim 1, comprising a threaded portion circumscribing the bottom end opening and a threaded part provided on the displaceable member, the displaceable member disposed within the bottom end opening with the threaded portion engaging the threaded part, the displaceable member axially movable by rotation.

15. A container according to claim 1, further comprising a flange member attached around the outside of the manipulable portion of the displaceable member and exterior to the container for facilitating movement of the displaceable member.

16. A container according to claim 1, wherein the closure member is a removable stopper adapted and configured to provide a fluid tight seal for the sealable opening in the bottom end of the housing.

17. A container according to claim 1, wherein the displaceable member is fitted in the opening in the bottom end of the housing.

18. A container according to claim 1, further comprising a sieve element located between the top end opening and the container contents.

19. A container according to claim 1, wherein a dry formulation is stored in the bottom compartment and a liquid is stored in the top compartment.

20. A container according to claim 1, wherein the materials of construction are resistant to sterilization procedures such as irradiation and gas treatment.

21. A container according to claim 1, further comprising packaging to provide protection to the components from ultraviolet rays, gases and vapors.

22. A container according to claim 1, wherein the displaceable member moves to the unsealed position by moving axially within the top compartment toward the container opening.

23. A container according to claim 1, wherein the neck portion has a radially-extending interior wall.

24. A container according to claim 23, wherein the partition wall has an annular projection and the inwardly extending radial wall has a groove, the projection and groove adapted and configured to cooperatively mate to form a liquid-tight seal.

25. A container according to claim 24, wherein the bottom end of the housing has a helical groove and the manipulable portion has pins which fit within the helical groove such that the displaceable portion is movable between said first and second position by rotating the manipulable portion.

26. A container according to claim 23, wherein the housing has side walls having substantially the same cross-section as the areas adjacent the neck portion.

27. A container according to claim 1, wherein the neck portion has a constricted neck portion which has a smaller cross-section than the areas adjacent to the housing.

28. A container according to claim 1, wherein one of either the partition wall or neck portion comprises an O-ring to provide a fluid-tight seal.

29. A container according to claim 1, wherein the partition wall is adapted and configured to form a reformable seal.

30. A container according to claim 1, wherein the partition wall and neck portion are configured and adapted such that the fluid-tight seal cannot be reestablished after the seal has been broken.

31. A container according to claim 1, wherein the displaceable member moves by rotating the manipulable portion to axially move the partition wall from a sealed position toward the bottom opening to an unsealed position.

32. A container according to claim 1, wherein the connecting member comprises longitudinal radial walls forming an X-cross-sectional configuration.

33. A container according to claim 1, wherein the connecting member comprises a cylindrically-shaped member having openings.

34. A container according to claim 1, wherein the container is prefilled and prepackaged and configured and adapted for a single use.

35. A container according to claim 34, wherein the partition wall is integrally connected to the housing side walls at the neck portion and the displaceable member tears the partition wall when it moves.

36. A container according to claim 35, wherein the partition wall is integrally formed with the neck portion by at least one of the group of ultrasonic welding, heat-sealing and gluing.

37. A container according to claim 35, wherein the partition wall is integrally connected to the side walls by an annular connecting zone and the partition wall separates from the housing side walls by breaking at the connecting zone.

38. A container according to claim 1 further comprising means to prevent refilling of the container.

39. A container according to claim 38, wherein the top end comprises an unremovable nipple assembly communicating with the top opening.

40. A container according to claim 38, wherein means to prevent refilling include an unremovable closure or sealing member to prevent access to either one of the first or second compartments.

41. A container according to claim 1 configured and adapted for feeding an infant including the use of a nipple assembly.

42. A container according to claim 41, wherein the partition wall and neck portion are configured and adapted such that a fluid-tight seal cannot be reestablished after the first use of the container.

43. A container according to claim 1 further comprising a dispensing outlet member which cannot be refastened after its removal to prevent the refilled container from properly dispensing its contents.

44. A container according to claim 1, wherein the displaceable member is displaced by rotating the manipulable portion to axially move the partition wall.

45. A container according to claim 1, wherein the displaceable member is displaced by pulling or pushing.

46. A container according to claim 45, wherein the displaceable member is movable by pushing or pulling the closure member sealing the bottom end opening.

47. A container according to claim 46, wherein the closure member has a flexible portion configured and adapted to permit the closure member to be moved.

48. A container according to claim 1 further comprising means to prevent unintentional movement of the displaceable member.

49. A container according to claim 48, further comprising means to prevent the unintentional axial movement of the displaceable member.

50. A container according to claim 1 further comprising a means for dispensing a predetermined quantity of the liquid formulation.

51. A container according to claim 50, wherein the means for dispensing a predetermined quantity of liquid formulation comprises a closure and dosing assembly, cooperating with the top end opening, comprising a lid which seals the top end opening, a side wall having openings and a bottom wall forming a compartment of a predetermined volume, the closure and dosing assembly moveable between a first position wherein the side wall openings communicate with the interior of the container and a second position wherein the side wall openings are sealed and the assembly can retain a predetermined amount of formulation.

52. A prefilled and prepackaged, single use, two-compartment container for separately storing two components and dispensing a formulation formed by mixing the two compartments comprising:

(a) a housing having side walls and an opening at each of its top and bottom ends;

(b) a partition wall in contact with the side wall of the housing between the top and bottom openings defining two separate compartments, the partition wall having an elongated connecting member which extends toward the bottom opening of the housing;

(c) a dispensing assembly communicating with the top opening of the housing for sealing the top opening and adapted to permit the contents to pass through to the exterior of the housing when desired; and (d) a displaceable bottom closure member in contact with the elongated connecting member of the partition wall;

wherein the bottom closure member is movable from a first position wherein the partition wall forms a seal between the two compartments to a second position which breaks the seal formed by the partition wall so that the two compartments intercommunicate and the stored components can be mixed.

53. A container according to claim 52, wherein the partition wall is integrally connected to the housing side walls.

54. A container according to claim 53, wherein the partition wall is integrally connected to the housing side walls by an annular connecting zone.

55. A container according to claim 53, wherein movement of the bottom closure member causes the partition wall to break at or adjacent to the annular connecting zone.

56. The container according to claim 55 wherein the displaceable member is displaced by axial pulling or pushing.

57. The container according to claim 56 wherein the bottom closure member seals the bottom end opening of the housing and is flexible to allow vertical displacement of the bottom closure member.

58. The container according to claim 57 wherein a handle is fixedly connected to the bottom wall.

59. A container according to claim 52, wherein the partition wall is connected to the housing side walls at an annular connecting zone.

60. A container according to claim 52, wherein the partition wall has a weakened area to promote breakage of the partition wall to unify the two compartments.

61. A container according to claim 52, wherein the elongated connecting member has a hollow cavity.

62. A container according to claim 61, wherein the elongated connecting member has an opening at its top communicating with the hollow cavity.

63. A container according to claim 52, wherein the partition wall has reinforcing ribs.

64. A container according to claim 52, wherein the partition wall cannot form a reformable seal.

65. A container according to claim 52, wherein the bottom closure member has a cup member projecting upwardly to receive the elongated connecting member.

66. A container according to claim 52, wherein the elongated connected member is connected to the bottom closure member.

67. A container according to claim 52, wherein the bottom closure member has an arcuate shape.

68. A container according to claim 67, wherein the bottom wall is movable in a direction toward the top opening of the housing to move the partition wall upwardly to unify the compartments.

69. A container according to claim 67, wherein the bottom closure member is flexible to permit movement from a downwardly arcuate shape to an upwardly arcuate shape.

70. A container according to claim 52 having a cover over the bottom closure member to prevent accidental use of or tampering with the container.

71. A container according to claim 52 wherein the housing has a constricted neck portion which has a smaller cross-section than the adjacent areas of the housing.

72. The container according to claim 71 wherein the neck portion has a circular cross section and the partition wall is circular.

73. The container according to claim 72 wherein the neck portion comprises an annular, radially, inwardly extending wall from the side walls of the housing.

74. The container according to claim 73 wherein the displaceable bottom closure member is displaced by rotating.

75. The container according to claim 74 wherein the displaceable bottom closure member has pins and the bottom end of the housing has a helical groove, the pins of the displaceable member adapted and configured to fit within the helical groove.

76. The container according to claim 75 further comprising a dosing assembly in communication with the top end opening of the housing in order to dispense a predetermined amount of container contents.

77. The container according to claim 75 wherein the bottom closure member includes a manipulable portion connected to the pins and fitted over the external surface of the side walls of the bottom end of the housing.

78. The container according to claim 73 wherein the annular, inwardly, extending wall has an annular groove and the partition wall has an annular projection, the annular groove and annular projection adapted and configured to cooperatively mate with one another to form a fluid tight seal.

79. The container according to claim 78 wherein the elongated connecting member comprises a cylindrical wall having openings.

80. The container according to claim 79 further comprising a closure member to seal the bottom end opening.

81. The container according to claim 71 wherein the housing is an integral design.

82. The container according to claim 71 wherein the housing is formed such that it cannot be separated at the neck portion without impairing the integrity of the housing.

83. A two-compartment container for separately storing two components, mixing the components and dispensing a formulation formed by mixing the two components comprising:

(a) a housing having substantially cylindrical side walls end an opening at each of its top end bottom ends;

(b) a top sealing member adapted and configured to fit over and seal the top end opening of the housing;

(c) a displaceable member configured and adapted to be movable within the housing having a partition wall at a first end which is configured and adapted to form a seal with the inner surface of the housing side wall, a manipulable portion at the second end adapted and configured to be controlled by a user to move the displaceable member; and a connecting member extending between the partition wall and the manipulable portion; and (d) a closure member sealing the bottom end opening of the housing;

wherein the displaceable member is movable between a first position where the partition wall forms a liquid tight seal and at least part of a common wall which divides the housing into two separate fluid tight compartments, and a second position where the partition wall is removed from the sealing position so that the two compartments can intercommunicate.

84. A container according to claim 83 wherein the housing side walls have a constricted neck portion which has a smaller cross section than the adjacent areas of the housing and is generally circular and the partition wall is also generally circular and configured and adapted to form the seal in the neck portion.

85. The container according to claim 84 wherein the housing is formed such that at the neck portion it can not be separated without impairing the integrity of the housing.

86. The container according to claim 85 wherein the partition wall and inner surface of the side walls of the housing at the constricted neck portion are configured and adapted to form a reformable seal.

87. The container of claim 86 wherein the neck portion comprises an annular, inwardly extending radial wall having an annular groove and the partition wall has an annular projection, the annular groove and annular projection adapted and configured to cooperating mate with one another to form a liquid-tight seal.

88. The container according to claim 87 wherein the connecting member comprises a generally cylindrically shaped wall having openings therein, a stopper fitted at one end and the partition wall at the other end of the cylindrically shaped wall.

89. The container according to claim 88 further comprising a groove in the side wall adjacent the bottom end opening of the housing, pins cooperatively associated with the displaceable member and fitted into the groove and the user manipulable portion connected to the pins and fitted over at least a portion of the bottom end of the housing adjacent the bottom end opening.

90. A two-compartment container for separately storing two components, mixing the components and dispensing a formulation formed by mixing the two components comprising:

(a) a housing having side walls and openings at opposite ends, the side walls adapted and configured to have a region with a smaller cross section than other adjacent regions of the housing;

(b) a top closure assembly adapted and configured to communicate with and seal the first open end, the top closure assembly including a closure member adapted and configured to be removable to allow the contents of the container to communicate with the exterior of the housing;

(c) a bottom displacement closure assembly adapted and configured to communicate with and seal the second open end of the housing, the bottom displacement closure assembly comprising a partition wall adapted and configured to form a seal at the neck portion, a manipulable portion in communication with the exterior of the container and accessible to a user; a bottom portion having an opening formed therein and adapted and configured to fit the second bottom end opening of the housing, a stopper adapted and configured to seal the bottom portion opening, and a connecting member connecting the bottom portion and the partition wall;

wherein the displaceable member is movable between a first position where the partition wall forms a liquid tight seal and at least a portion of common wall which divides the housing into two separate liquid tight compartments, and a second position where the partition wall is disengaged from the sealing position so that the two compartments communicate.

91. The container of claim 90 further comprising an annular engagement member having a groove, the annular member projecting inwardly from the neck portion, and an annular projection on the partition wall, wherein the annular projection and annular groove are adapted and configured to cooperatively mate to form a fluid tight seal.

92. The container of claim 91 wherein the stopper is removable to allow a component to be introduced into the bottom end of the container and the connecting wall comprises a generally cylindrical wall having openings.

93. The container according to claim 92, wherein the manipulable portion is movable by rotation.

94. The container according to claim 93 wherein the top opening is fitted with a baby's feeding nipple.

95. A two-compartment container for separately storing two components, mixing the components and dispensing a formulation formed by mixing the two components comprising:

a housing having an opening at each of its top and bottom ends;

a displaceable member substantially disposed and fitted within the bottom end of the housing in a displaceable manner, the displaceable member having a partition wall adapted to form a liquid-tight seal at its first end, a bottom portion at its second end having an opening formed therein and adapted and configured to fit within the bottom end opening of the housing, a stopper adapted and configured to seal the bottom portion opening, and a connecting member connecting the bottom portion and the partition wall and adapted and configured to provide at least one opening between the partition wall and the bottom portion;

wherein the displaceable member is adapted and configured to seal the bottom open end of the housing and is moveable between a first position wherein the partition wall forms a liquid tight seal and at least a portion of a common wall which divides the housing into a top and bottom compartment, and a second position where the partition wall is disengaged from the sealing position so that the two compartments communicate.

96. The container according to claim 95, wherein the connecting wall comprises a generally cylindrical wall having openings.

97. The container according to claim 95, wherein the displaceable member is movable by rotation.

98. The container according to claim 97, wherein the bottom end of the housing has threads associated therewith, and the bottom portion of the displaceable member has cooperating threads thereon such that the displaceable member is screw-engaged with the bottom end of the housing and is moveable by rotating the displaceable member which provides axial movement of the partition wall.

99. The container according to claim 95, further comprising a manipulable portion on the exterior of the housing connected to the bottom portion of the displaceable member.

100. The container according to claim 99, wherein the displaceable member is movable by rotating the manipulable portion.

101. The container according to claim 100, wherein the housing has at least one helical groove formed in the bottom end and the manipulable portion is connected to the bottom portion by pins which move within the helical groove.

102. The container according to claim 95, wherein the housing is an integral design.

103. The container according to claim 102, wherein the housing was formed as a single piece.

104. The container according to claim 95, wherein the housing has a constricted neck portion.

105. The container according to claim 95 wherein the displaceable member has a passageway between the opening in the bottom portion and the opening in the connecting member to allow material to be added or removed from the container.

* * * * *